US010088266B1

(12) United States Patent
Fournerat

(10) Patent No.: US 10,088,266 B1
(45) Date of Patent: Oct. 2, 2018

(54) ANTI-RECOIL DEVICE ACCESSORY FOR A FIREARM

(71) Applicant: Robert Fournerat, Irving, TX (US)

(72) Inventor: Robert Fournerat, Irving, TX (US)

( * ) Notice: Subject to any disclaimer, the term of this patent is extended or adjusted under 35 U.S.C. 154(b) by 0 days.

(21) Appl. No.: 15/603,043

(22) Filed: May 23, 2017

(51) Int. Cl.
*F41C 23/06* (2006.01)

(52) U.S. Cl.
CPC ..... *F41C 23/06* (2013.01)

(58) Field of Classification Search
CPC ..... F41C 23/06; F41C 23/08
USPC ..... 42/1.06; 89/14.3, 42.01–44.02
See application file for complete search history.

(56) References Cited

U.S. PATENT DOCUMENTS 2,720,819 A * 10/1955 Ryan ..... F41A 25/00 192/21.5
2,818,783 A * 1/1958 Carlson ..... F41A 25/00 89/42.01
3,461,589 A * 8/1969 Vironda ..... F41C 23/06 42/1.06
3,492,749 A * 2/1970 Vironda ..... F41C 23/06 42/74
5,265,852 A * 11/1993 Taylor ..... F16F 9/0218 188/322.17
6,644,168 B1 * 11/2003 Browne ..... F16F 9/461 89/42.01
6,694,856 B1 * 2/2004 Chen ..... F16F 9/535 89/43.01
6,901,689 B1 * 6/2005 Bergstrom ..... F41A 25/20 42/1.06
2003/0154640 A1 * 8/2003 Bragg ..... F41C 23/08 42/74
2010/0122482 A1 * 5/2010 Simms ..... F41C 23/08 42/1.06
2015/0226507 A1 * 8/2015 Palmer ..... F41A 1/08 89/1.703
2016/0040743 A1 * 2/2016 Staton ..... F16F 13/005 2/412

* cited by examiner

*Primary Examiner* — Bret Hayes
(74) *Attorney, Agent, or Firm* — Gregory M. Howlson

(57) ABSTRACT

An anti-recoil device is for being inserted in the stock of a firearm is provided. The anti-recoil device may include a cylindrical tube having a hollow core, a reciprocating magnet which can slide back and forth within the hollow core, and an end magnet disposed at each end of the hollow core, with the magnets oriented such that the magnetic poles of the reciprocating magnet face like poles of the end magnets. During operation, the recoil force of the firearm is partially counteracted by the interaction of the repelling magnetic forces. In some embodiments, the anti-recoil device includes a metal coil with windings around the exterior of the cylindrical tube. In other embodiments, the anti-recoil device includes air vents which allow the reciprocating magnet to create air cushions within the cylindrical tube.

22 Claims, 16 Drawing Sheets

ANTI-RECOIL DEVICE ACCESSORY FOR A FIREARM

TECHNICAL FIELD

The following disclosure relates to devices used to reduce recoil in firearms.

BACKGROUND

Using firearms for hunting and sport shooting continue to be popular activities in the United States and around the world. However, many shooters experience difficulty using rifles or shotguns for extended periods of time due to the recoil force from firing the guns.

SUMMARY

An anti-recoil device for a firearm is provided that is used to reduce the recoil force from a firearm. The anti-recoil device includes a cylindrical tubular body and two tubular end caps. An end magnet is secured in each end cap, and a central magnet is disposed within the interior of the tubular body such that it can slide back and forth within the tubular body interior. The magnets are oriented such that the magnetic poles of the central magnet are facing like poles of each of the end magnets. The anti-recoil device is installed in the bolt hole of the stock of a firearm. When the gun is fired, the recoil force drives the body of the device, along with the end magnets, backwards, while the central magnet slides forward within the tubular body interior. The interaction of the magnetic forces between the magnets results in forces which partially counteract the recoil force of the firearm. Some embodiments of the anti-recoil device include an electromagnetic coil. Other embodiments include air vents which act to produce an air cushion effect on the central magnet.

BRIEF DESCRIPTION OF THE DRAWINGS

For a more complete understanding, reference is now made to the following description taken in conjunction with the accompanying Drawings in which.

DETAILED DESCRIPTION

Figure 1A:
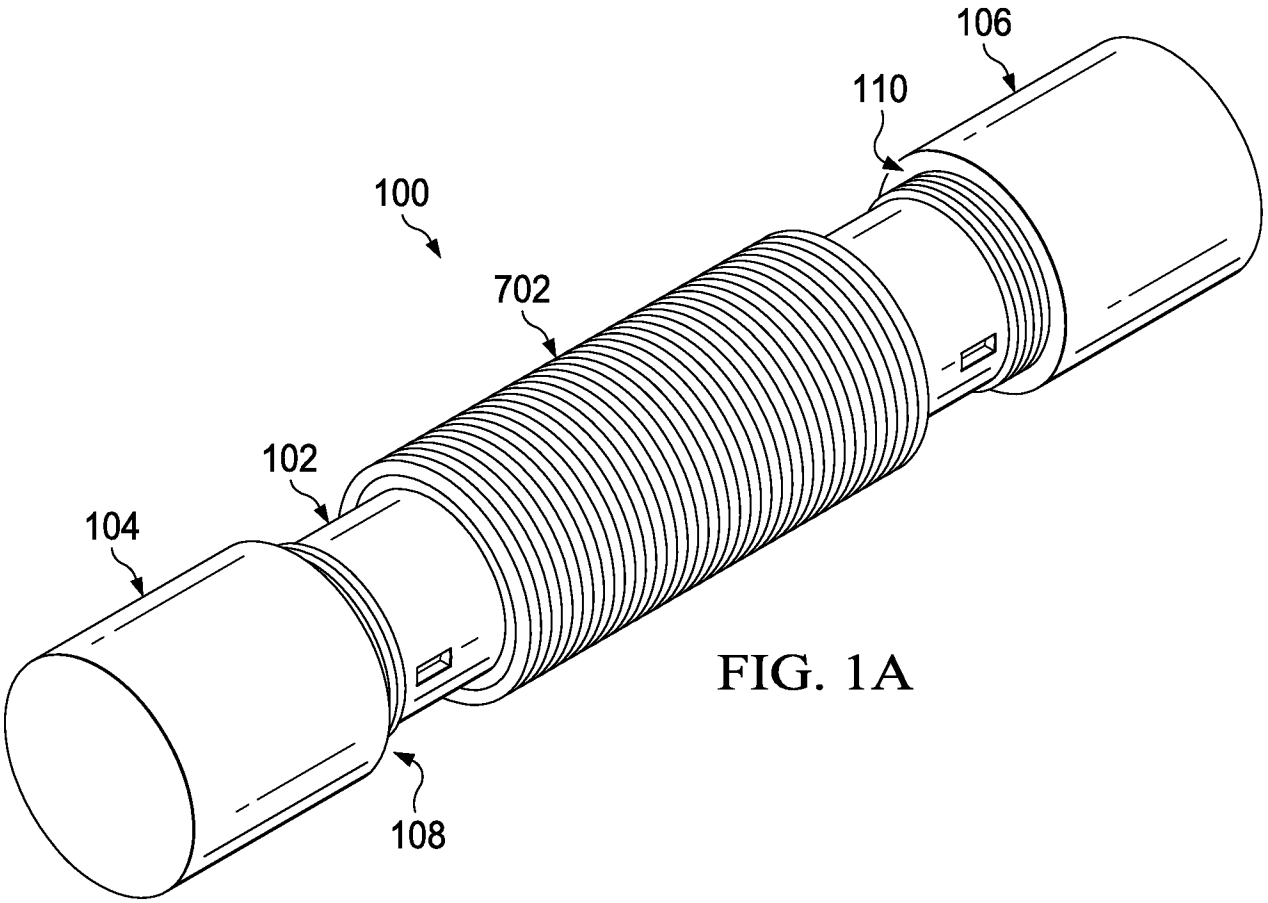
FIG. 1A illustrates a perspective view of an embodiment of an anti-recoil device.

Referring now to the drawings, wherein like reference numbers are used herein to designate like elements throughout, the various views and embodiments of anti-recoil device are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Referring to FIG. 1A, there is illustrated an embodiment of an anti-recoil device 100. The anti-recoil device 100 includes a hollow cylindrical body 102 with two open ends 108, 110. The end caps 104, 106 are positioned at the open ends 108, 110 of the cylindrical body 102 and fit over the ends 108, 110.

Figure 1B:
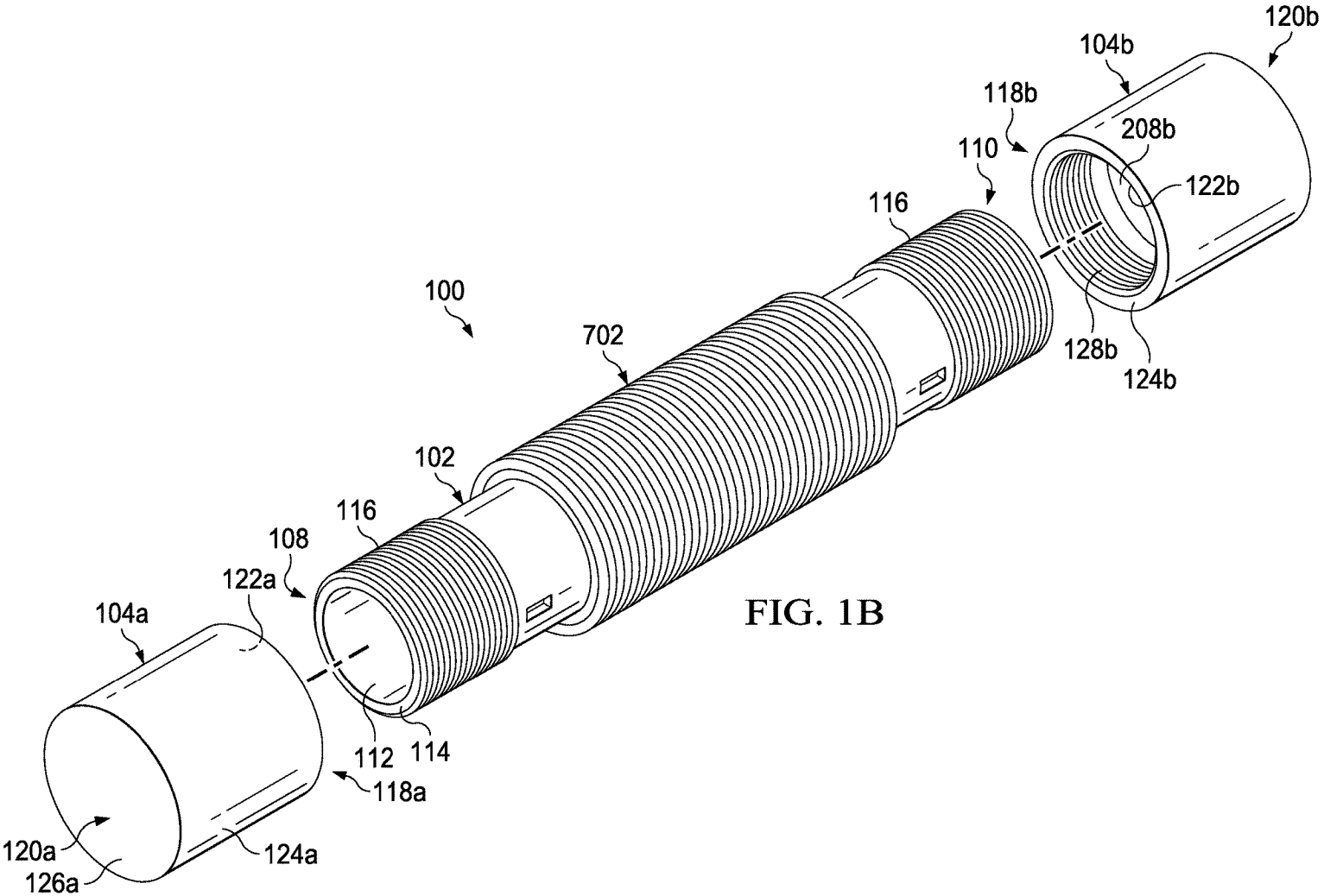
FIG. 1B illustrates a perspective view of an embodiment of an anti-recoil device with the end caps removed.

Referring to FIG. 1B, there is illustrated an anti-recoil device 100 as depicted in FIG. 1A, except that the end caps 104 have been removed from the ends 108, 110 of the cylindrical body 102. The cylindrical body 102 has a body interior 112 formed by the cylindrical body wall 114. The outside face of the cylindrical body wall 114 includes threaded portions 116 near the cylindrical body ends 108, 110. Each end cap 104, 106 is a hollow cylinder with an open end cap end 118 and a closed end cap end 120. Each end cap 104 has an end cap interior 122 formed by the interior faces of an end cap side wall 124 and an end cap end wall 126 at the closed end cap end 120. Each end cap 104 is sized such that the at least a portion of the end cap side wall 124 proximate the end cap open end 118 can fit over the cylindrical body ends 108, 110. The inside face of each end cap side wall 124 also includes a threaded portion 128. The cylindrical body wall threaded portions 116 and the end cap wall threaded portions 128 are configured in a complimentary way such that the end caps 104 can threadebly engage (screw) onto the ends 108, 110 of the cylindrical body 102. With the end caps attached to the ends 108, 110 of the cylindrical body 102, a continuous device interior portion is formed by the combination of the body interior 112 with the end cap interiors 122.

As described hereinabove, the embodiment illustrated in FIGS. 1A and 1B includes end caps 104, 106 which screw onto the ends 108, 110 of the cylindrical body 102. In other embodiments, the end caps 104 may be attached to the body 102 in other ways, such as with a locking mechanism that allows the end caps to snap onto the body ends, or with an adhesive that affixes the end caps to the ends of the cylindrical body. In other embodiments, the end caps 104 may be formed as part of the cylindrical body 102 itself.

Figure 2:
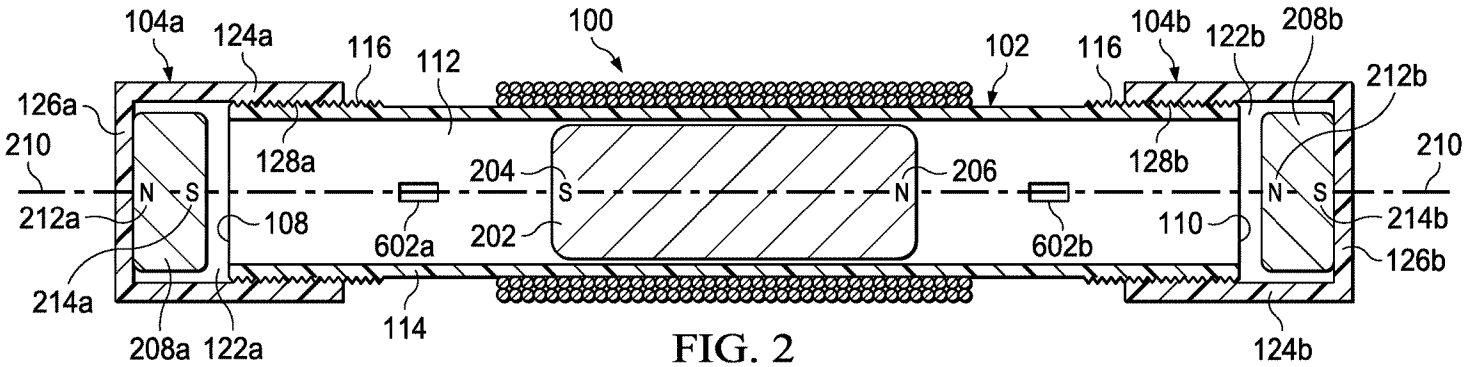
FIG. 2 illustrates a cross-section side view of an anti-recoil device.

Referring now to FIG. 2, there is illustrated a cross-sectional view of an the embodiment of an anti-recoil device as depicted in FIGS. 1A and 1B. Visible in FIG. 2 is a central magnet 202 within the body interior 112 of the cylindrical body. The central magnet 202 is a permanent magnet made of a strongly magnetic material, such as iron, nickel, cobalt, or neodymium. Neodymium is an especially (but, by no means only) suitable material due to its ability to maintain a strong magnetic field compared to other materials. The central magnet 202 fits within the body interior 112 and is "free floating;" that is, it is not affixed to the cylindrical body wall 114 or any other structure of the anti-recoil device 100 and can move freely back and forth within the body interior 112 along a longitudinal axis 210 which extends through the center of the device 100 along a line connecting one open end 108 and the other open end 110. The central magnet 202 is positioned within the body interior 112 such that one magnetic pole 204 of the central magnet faces one open end 108, while the other magnetic pole 206 faces the other open end 110. Preferably, the central magnet 202 is cylindrical or roughly cylindrical, but it can be of any shape that will allow the central magnet to move freely back and forth within the body interior 112 while also constraining the movement of the central magnet so that the magnetic poles 204, 206 will stay facing the correct open ends 108, 110 and aligned along the longitudinal axis 210. The anti-recoil device 100 includes two end cap magnets 208, with each end cap magnet 208 being disposed within one of the end cap interiors 122. Like the central magnet 202, the end magnets are preferably cylindrical or roughly cylindrical or disk-shaped. The end magnets 208 are permanent magnets made of a strongly magnetic material, such as iron, nickel, cobalt, or neodymium. In some embodiments, such as is shown in FIG. 2, each end magnet 208 is fixed within its respective end cap 104. Other embodiments, which are discussed hereinbelow with respect to FIG. 9, have end cap magnets 208 that are not fixed in position. Some embodiments include end cap magnets 208 mounted within the cylindrical body 102. For the embodiments with fixed end cap magnets 208, each magnet is affixed to its respective end cap side wall 124 and/or end wall 126. The end cap magnets 208 are affixed via any appropriate means. In various embodiments, this includes, for example, a press fit within the end cap side wall 124 or an adhesive between the end cap magnet 208 and the end cap sidewall 124 or 126. Each end cap magnet 208 has its magnetic poles 212, 214 aligned along the longitudinal axis 210. The end magnets 208 are oriented such that each of the magnetic poles 214*a* and 212*b* facing the central magnet 202 is a like (or "repelling") pole with respect to the magnetic pole 204 or 206 which faces that respective end magnet 208. In other words, magnetic poles 214*a* and 204 are like poles, and magnetic poles 212*b* and 206 are like poles. Thus, there is a repelling magnetic force between central magnet 202 and the first end magnet 208*a* and a repelling magnetic force between the central magnet and the second end magnet 208*b*. In the embodiment of FIG. 2, end cap magnets 208 are substantially identical in size, mass, and magnetic strength to each other, however, in some embodiments, the size, mass, and/or magnetic strength of the end magnets 208 will differ from each other.

The exact dimensions and specifications of various components of the anti-recoil device 100 will vary from embodiment to embodiment. However, since the anti-recoil device 100 is meant to be installed in the bolt hole of a firearm (as described hereinbelow with respect to FIGS. 3-4) many of the specifications, such as the maximum diameter of the device and the maximum length of the device, are at least related to the dimensions of bolt holes in common firearms. In some embodiments, the maximum diameter of the anti-recoil device 100, which is also the diameter of the end caps 104 is ⅞ inch. In other embodiments, the diameter of the end caps is between ¾ inch and 1 inch. In some embodiments, the length of the anti-recoil device 100 (from the outer face of the end cap end wall 126*a* to the outer face of the end cap end wall 126*b*) is 130 mm. In other embodiments, this length is between 100 mm and 150 mm. In some embodiments, the length of the central magnet 202 is 2 inches, while in other embodiments, the length of the central magnet is between 1.25 inches and 2.5 inches. In some embodiments, the diameter of the central magnet 202 is ½ inch, while in other embodiments, the diameter of the central magnet is between ⅜ inch and ¾ inch. In some embodiments, the thickness of the end magnets 208 is ⅜ inch, while in other embodiments, the thickness of the end magnets is between ¼ inch and ⅝ inch. In some embodiments, the diameter of the end magnets 208 is ⅝ inch, while in other embodiments, the diameter of the end magnets is between ½ inch and ¾ inch. In some embodiments, the diameter of the central magnet 202 will be substantially similar to the diameter of the body interior 112. In other words, the central magnet 202 can slide freely within the body interior 112, but minimal amounts of air can pass between the central magnet and the interior surface of the cylindrical body wall 114.

The cylindrical body 102 and the end caps 104 can be made of various materials. In some embodiments, the cylindrical body 102 and end caps 104 are made of PETG (Polyethylene Terephthalate Glycol). PETG is a particularly useful material, as it is very smooth, with low friction between its surface and metal surfaces (such as the central magnet 202). It also has self-lubricating properties and is impact resistant. Some embodiments will have a cylindrical body 102 and end caps 104 made of other types of plastic. Some embodiments will have a cylindrical body 102 and end caps 104 made out of a non-magnetic metal, while others will use ceramics, or even wood.

In some embodiments, the central magnet 202 and/or the end magnets 208 have protective cushions, coatings, or sleeves to protect against inadvertent impacts between the central magnet and either of the end magnets. For example, in some embodiments, one or more of the magnets is coated with a plastic or rubber coating. In other embodiments, one or more of the magnets is wrapped in a thin plastic or foam sleeve. In yet other embodiments, a thin impact-absorbing rubber cushion is affixed to each end of the central magnet 202.

Different embodiments will have different strength magnets. One frequently used measure of the magnetic strength of a magnet is an "N-rating." In some embodiments, the N-rating of the central magnet 202 will be N50. Other embodiments, however, will have central magnet 202 strengths anywhere from N48-N52. Some embodiments will have end 208 magnet N-ratings of N25, while other embodiments will have end magnet 208 N-ratings of N25-N32.

Figure 3:
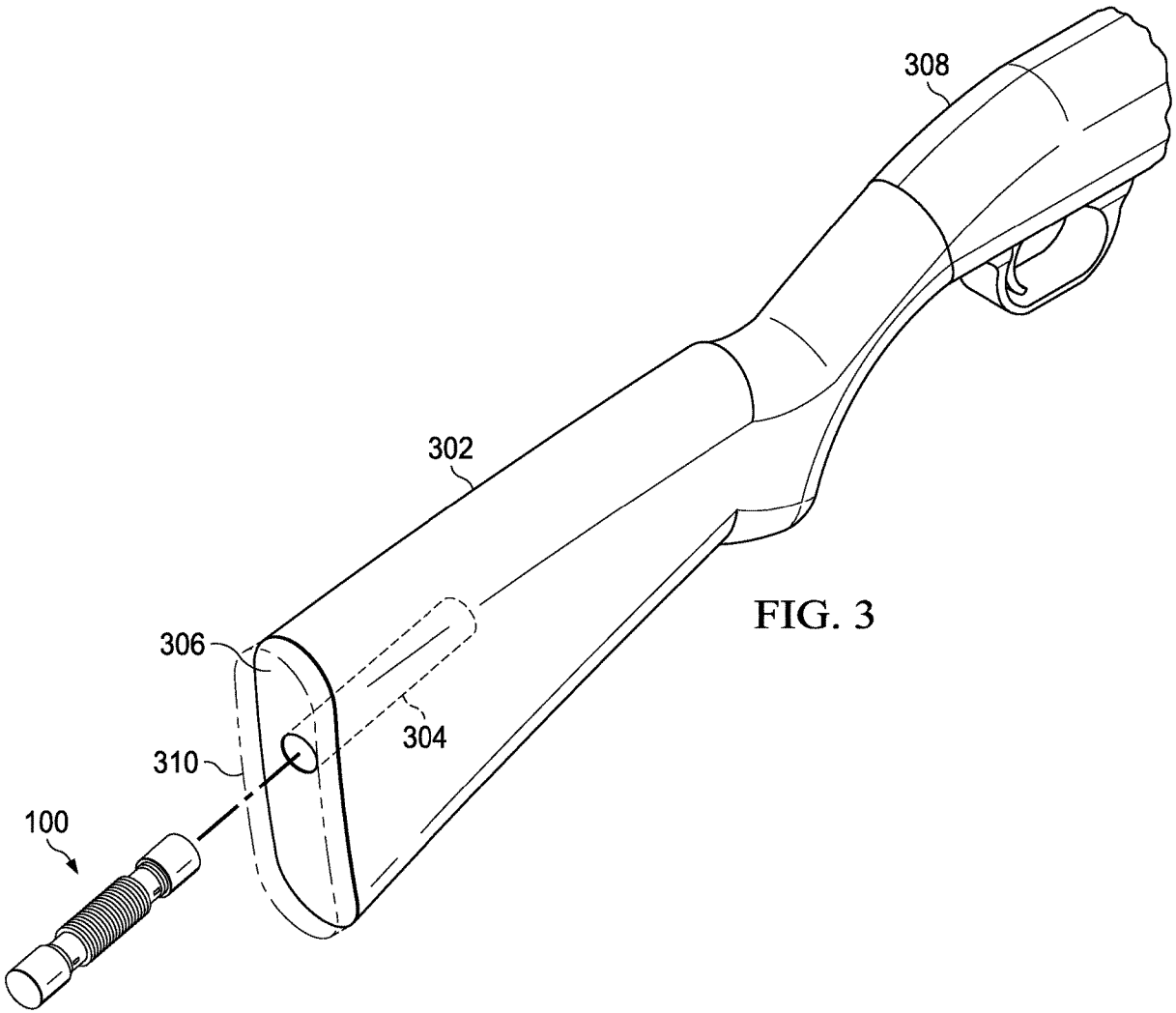
FIG. 3 illustrates a rear perspective view of an anti-recoil device and a gun stock.

Referring now to FIG. 3, there is illustrated a perspective view of how an anti-recoil device 100 is installed into the stock of a firearm. Many long guns (rifles and shotguns) have bolts which attach the stock of the firearm to the firearm receiver. Bolt holes generally roughly cylindrical holes that drilled or formed in the stock of the firearm to facilitate this bolt. Turning back FIG. 3, stock 302 is a stock on a firearm, such as would be found on a rifle or shotgun. Bolt hole 304 is a hole in the stock 302 that extends from the rear face 306 of the stock forward through the stock to the back of the receiver 308. Typically, a butt plate or butt pad 310 (shown removed) is attached to the rear face 306 of the stock 302. To install the anti-recoil device 100 into the firearm, the butt plate 310 is removed from the rear face 306 of the stock 302, exposing the bolt hole 304. The anti-recoil device 100 is then inserted into the bolt hole 304 such that the entire anti-recoil device is disposed within the bole hole. The butt plate 310 is then reattached to the rear face 306 of the stock 302, covering the bolt hole 304 and securing the anti-recoil device 100 within the bolt hole.

Figure 4:
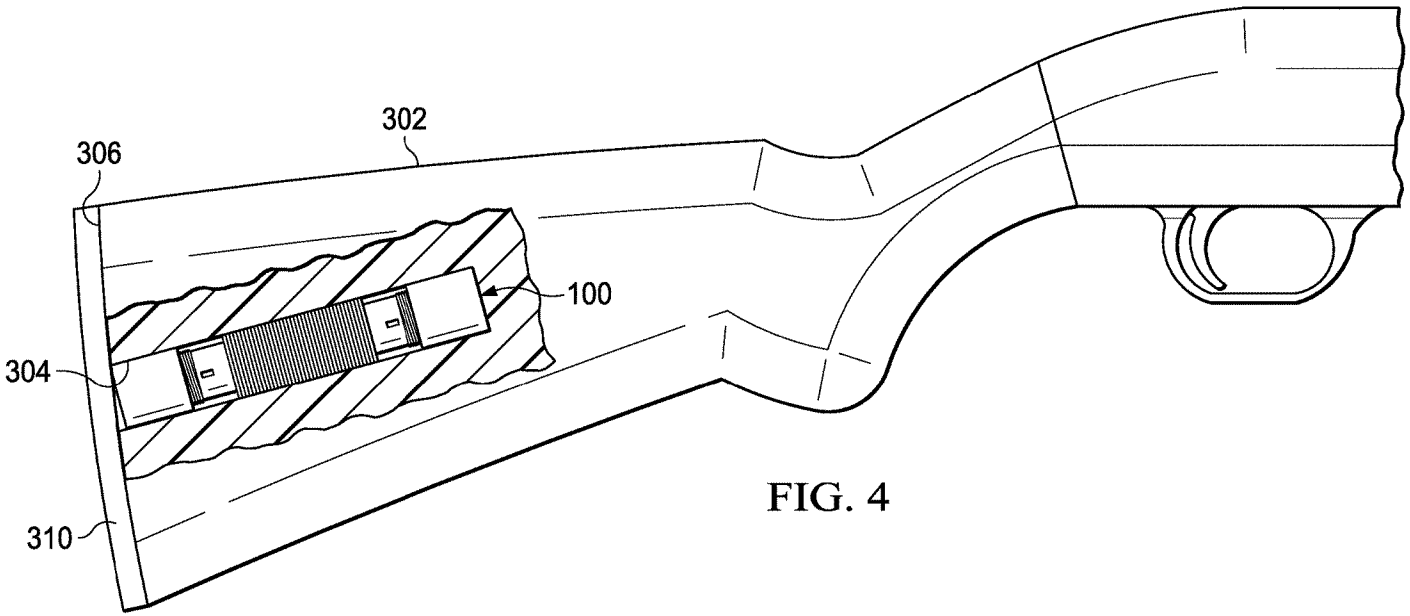
FIG. 4 illustrates a cut-away side view of an anti-recoil device in the bolt hole of a gun stock.

Referring now to FIG. 4, there is illustrated a cut away side view of the rear portion of a firearm with an anti-recoil device installed. In FIG. 4, a portion of the side of the stock 302 has been removed for ease of understanding to allow visibility of the bolt hole 304 and the anti-recoil device 100. In FIG. 4, the anti-recoil device 100 has been installed into the firearm bolt hole 304, and the butt plate 310 has been reattached to the rear face 306 of the stock 302, securing the anti-recoil device within the bolt hole. In the embodiment shown in FIG. 4, the anti-recoil device 100 is the same length as the bolt hole 304. Thus, when the butt plate 310 is instilled, the anti-recoil device 100 is secured and prevented from moving back and forth along the length of the bolt hole. In other embodiments, the bolt hole 304 is longer than the length of the anti-recoil device. These embodiments are discussed in detail hereinbelow with respect to FIGS. 10-12.

Referring now to FIGS. 5A-F, there are illustrated cross section side views which depict the operation of the embodiment of the anti-recoil device 100 illustrated in FIGS. 1-4. When the firearm is fired, the recoil force will push the firearm and the anti-recoil device 100 backward. The central magnet 202, which is not fixed to the rest of the anti-recoil device 100, will be forced forward and slide forward within the cylindrical body interior 112 (from the point of view of the anti-recoil device). The interaction of the repelling magnetic forces between the central magnet 202 and the end magnets 208 will act like a spring which will counteract some of the recoil force of the firearm, as described in detail hereinbelow.

Figure 5A:
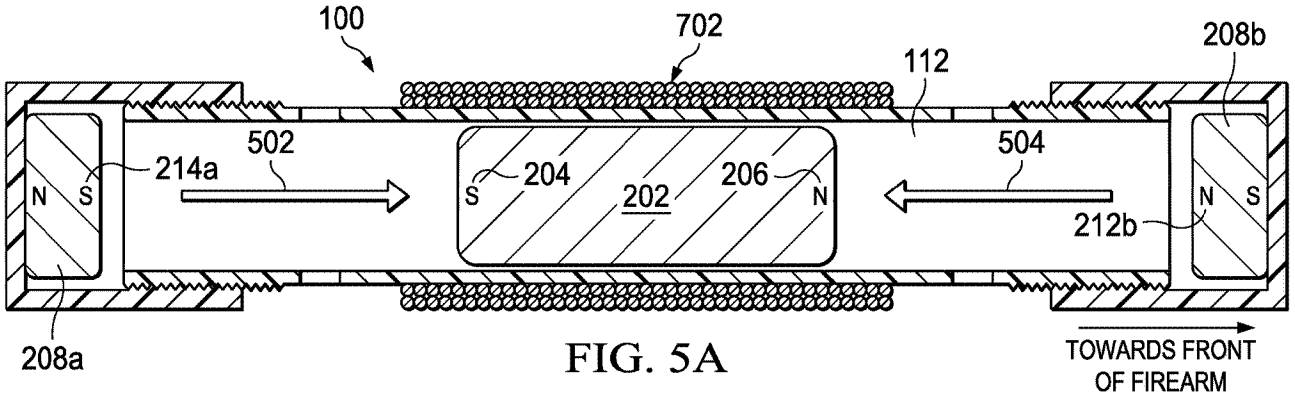
FIGS. 5A-5F illustrate cross-section side views of an embodiment of an anti-recoil device during operation of the device.

Turning first to FIG. 5A, the anti-recoil device 100 in its resting state; that is, its steady state before the firearm in which it is installed is fired, has the central magnet 202 in the cylindrical body interior 112 centered in-between the end magnets 208*a* and 208*b*. In this state, with the central magnet 202 not moving and being equidistant from each of the end magnets 208, the repelling magnetic force (depicted by arrow 502) between the end magnet 208*a* and central magnet 202 and the repelling force (depicted by arrow 504) between the end magnet 208*b* and the central magnet are equal and opposite, resulting in no net magnetic force on the central magnet.

Figure 5B:
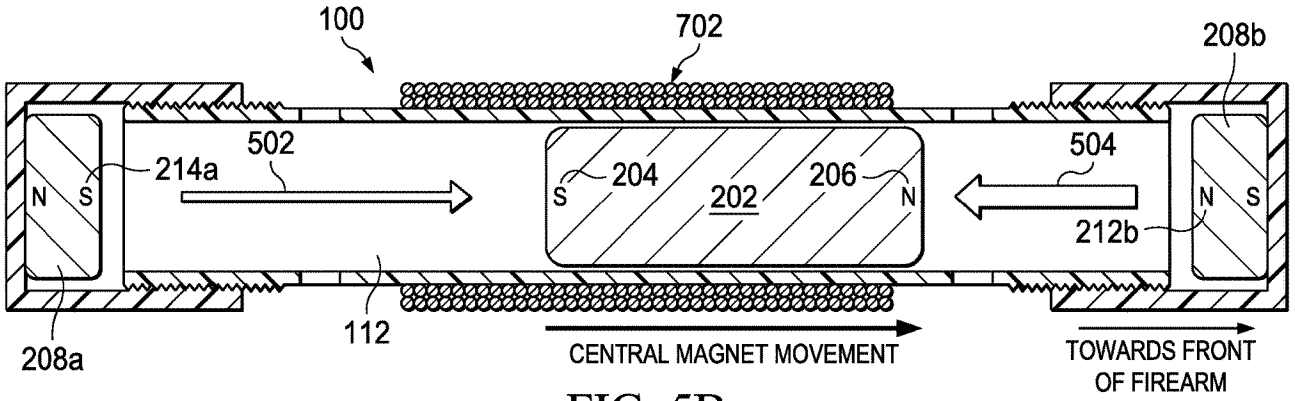

Referring next to FIG. 5B, there is illustrated a cross section view of an anti-recoil device just after the gun is fired. The recoil of the gun being fired accelerates the firearm, including the stock 302, backwards. The anti-recoil device 100, being securely fixed within the bolt hole 304 of the stock 302, is also accelerated backwards. However, the central magnet 202, since it is not fixed to the interior of the cylinder body wall 114 and is free floating within the body interior 112, does not have any force transferred to it by the recoil of the firearm, and so is not accelerated backwards along with the rest of the anti-recoil device.

It will be understood that even though the central magnet 202 remains still and the rest of the anti-recoil device 100 moves backwards when the firearm is fired, relative to the firearm and the other components of the anti-recoil device, the central magnet moves forward towards the front of the firearm. Thus, for ease of understanding, throughout this application, the movements of the various parts of the anti-recoil device will be described from a frame of reference in which the firearm and the fixed components of the anti-recoil device 100 (such as the cylindrical body 102 and end caps 104) do not move, and the central magnet 202 moves forward and backward within the body interior 112. This frame will be referred to herein as the "body-fixed" frame.

Using the body-fixed frame, when the firearm is fired, the central magnet 202 undergoes a short, but very large, acceleration toward the front of the firearm. The central magnet 202, now having a high velocity in the direction of the front of the firearm slides within the body interior 112 forward towards the front of the firearm and the end magnet 208*b*. As the central magnet 202 moves forward towards end magnet 208*b*, the distance between like poles 206 and 212*b* (on the central magnet 202 and the end magnet 208*b*, respectively) decreases, while the distance between like poles 204 and 214*a* (on the central magnet 202 and the end magnet 208*a*, respectively) increases. This means the repelling force between central magnet 202 and the end magnet 208*a* decreases, while the repelling force between the central magnet 202 and the end magnet 208*b* increases. This imbalance of forces causes an acceleration of the central magnet 202 back in the direction of the end magnet 208*a*, which results in the central magnet slowing down in its movement towards end magnet 208*b*. The repelling force between the central magnet 202 and the end magnet 208*b* continue to increase as the central magnet continues moving towards the end magnet 208*b* and the front of the firearm.

It will be understood that the imbalance in repelling forces 502, 504 results in a net force on the central magnet 202 towards the end magnet 208*a* and the rear of the firearm. Of course, a net rearward force on the central magnet 202 applied by the end magnets 208 and the rest of the anti-recoil device 100 as a whole means there is a net forward force (in the direction of the front of the firearm) applied by the central magnet to the rest of the anti-recoil device. This forward force is transferred to the firearm in which the anti-recoil device 100 is installed and helps counteract a portion of the recoil force experienced by the firearm its user when the firearm is fired.

Figure 5C:
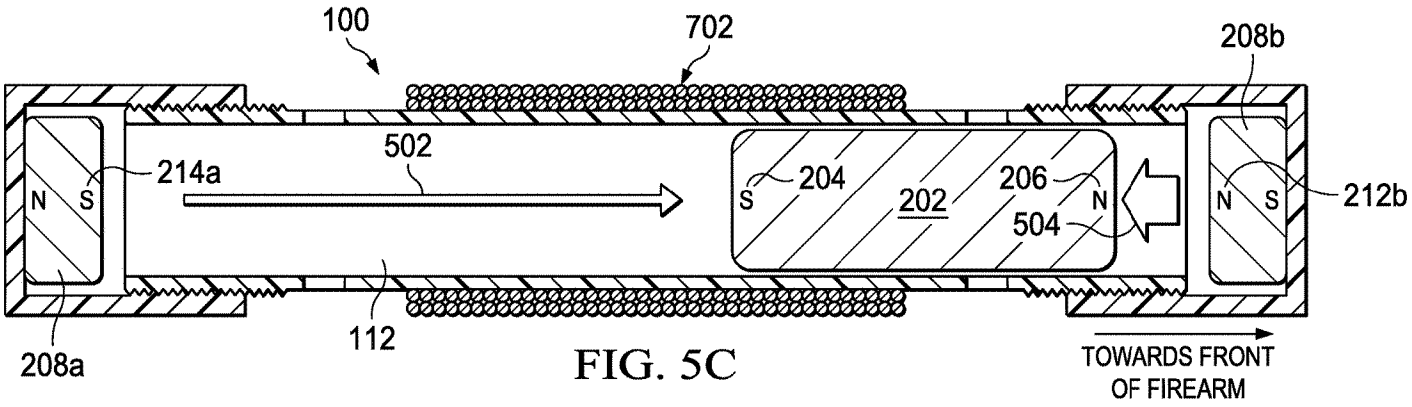

Turning now to FIG. 5C, there is illustrated a cross section side view of an anti-recoil device 100 in the next state, following that which is depicted in FIG. 5B, of the sequence in which a firearm having an anti-recoil device 100 installed is fired. As described hereinabove with respect to FIG. 5B, as the central magnet 202 moves forward through the cylindrical body interior 112 towards the end magnet 208*b*, repelling magnetic force 504 between the central magnet and the end magnet 208*b* increases, increasing the acceleration of the central magnet toward end magnet 208*a*, causing the central magnet to slow down at an increasingly rapid rate. FIG. 5C depicts the point in time at which the central magnet 202 been slowed to a complete stop by the increasing repelling force 504. At this point, the central magnet 202 is much closer to the end magnet 208*b* than to the end magnet 208*a*, resulting in a greatly increased repelling force 504 and a greatly reduced repelling force 502 and a continued acceleration of the central magnet backwards towards end magnet 208*a*.

Figure 5D:
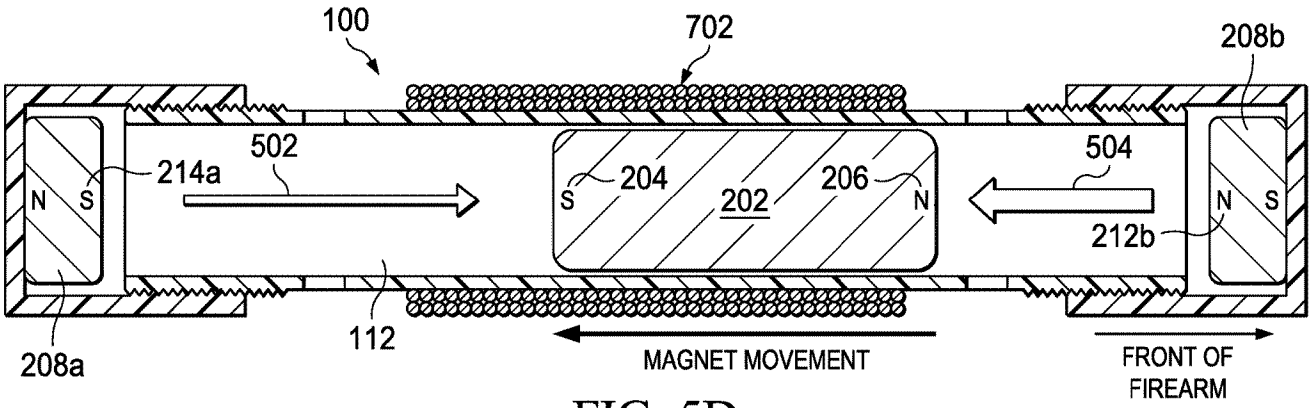

Turning now to FIG. 5D, there is illustrated a cross section side view of the same embodiment of an anti-recoil device from FIGS. 5A-C. At this point in the operation of the anti-recoil device 100, the forward movement of the central magnet 202 towards the end magnet 208*b* has been completely halted by the repelling magnetic force 504. The continued imbalance between repelling magnetic forces 502 and 504 has caused central magnet 202 to continue accelerating rearward towards end magnet 208*a* to the extent that the central magnet has begun moving (at an increasing rate) through the cylindrical body interior 112 towards the end magnet 208*a*. As this movement occurs, the repelling magnetic force 502 between the central magnet 202 and the end magnet 208*a* begins to increase, while the repelling magnetic force 504 between the central magnet and the end magnet 208*b* begins to decrease.

Figure 5E:
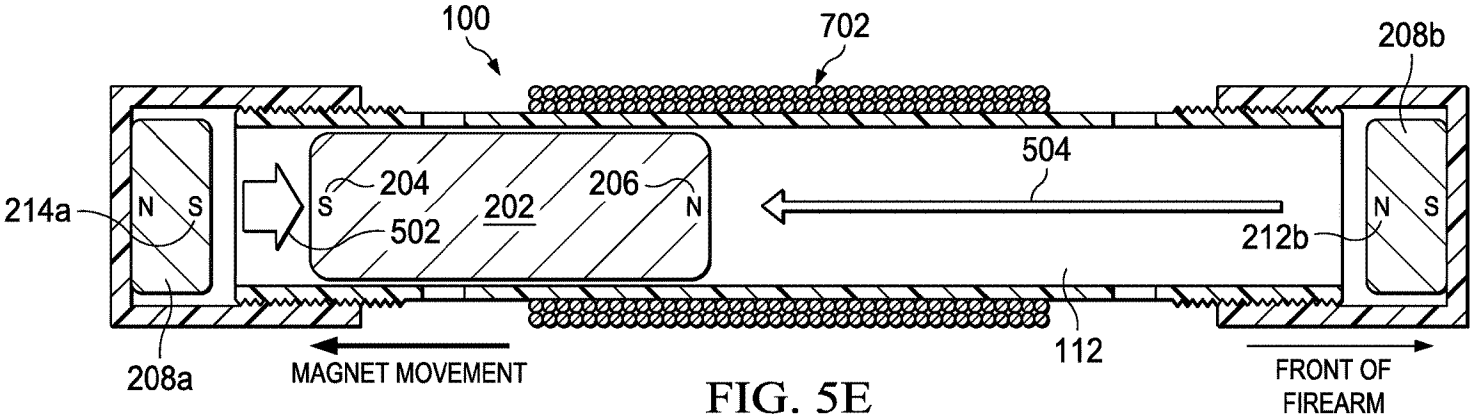

Turning now to FIG. 5E, there is illustrated a cross section side view of the same embodiment of an anti-recoil device from FIGS. 5A-D. At this point in the operation of the anti-recoil device 100, the central magnet 202 has continued moving rearward through the cylindrical body interior 112 towards the end magnet 208*a*. The momentum of the central magnet 202 moving in the rearward directions has caused the central magnet to move past the point equidistant between end magnets 208*a* and 208*b* where the repelling forces 502 and 504 on the central magnet are equal and opposite. The repelling magnetic force 502 continues to increase as the central magnet 202 moves towards end magnet 208*a*, while the repelling magnetic force 504 continues to decrease. This creates an imbalance in the repelling magnetic forces 502 and 504 which results in a net magnetic force on the central magnet 202 in the forward direction towards the end magnet 208*b* and the front of the firearm. This forward net force the central magnet 202, which still has a velocity in the rearward direction towards end magnet 208*a*, causes the central magnet begin accelerating in the forward direction towards end magnet 208*b*. This means the velocity of the central magnet 202 in the direction of the end magnet 208*a* begins to decrease and, as the central magnet moves closer to the end magnet 208*a*, decrease at an increasing rate.

Figure 5F:
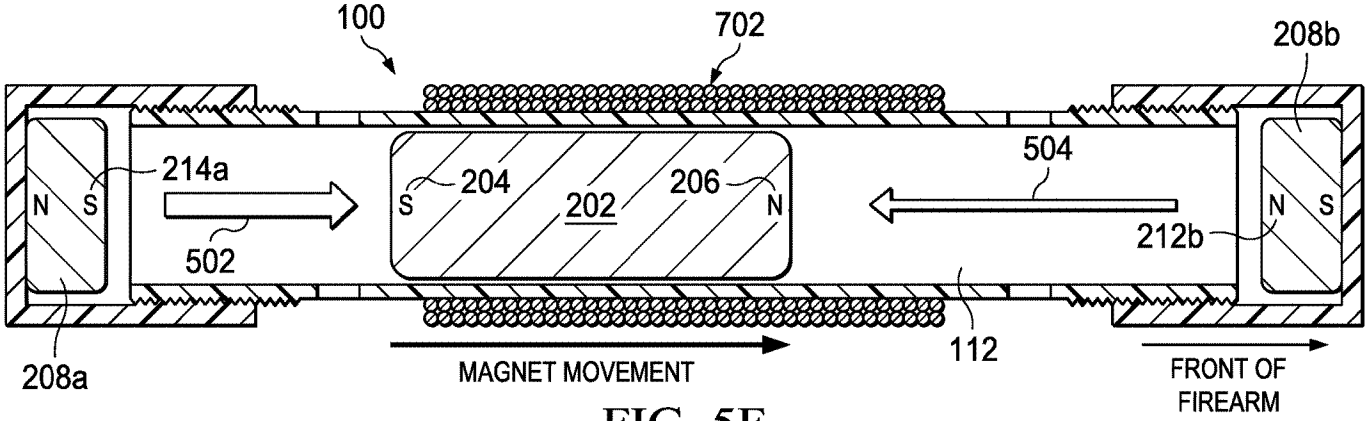

Turning now to FIG. 5F, there is illustrated a cross section side view of the same embodiment of an anti-recoil device 100 from FIGS. 5A-E. At this stage in the operation of the anti-recoil device, the central magnet 202, which in FIG. 5E had been moving towards the end magnet 208*a*, has been stopped and is being pushed back in the forward direction towards the end magnet 208*b* by the forward net force caused by the repelling magnetic force 502 being larger than the repelling magnetic force 504. The central magnet 202 continues moving forward towards the end magnet 208*b*. At this happens, the repelling magnetic force 502 between end magnet 208*a* and the central magnet 202 decreases, and the repelling magnetic force 504 increases. The central magnet 202 begins to slow down as it moves forward towards the end magnet 208*b*.

At this point, the central magnet 202 is moving forward towards the end magnet 208*b*, and it will continue to do so until the repelling magnetic force 504 increases to the point where the central magnet's velocity again changes direction and it beings moving back towards end magnet 208*a*. The central magnet 202 will repeat the stages described hereinabove with respect to FIGS. 5B-F, oscillating forward and backward between the end magnets 208*a* and 208*b* within the cylindrical body interior 112. As the central magnet 202 moves through the cylindrical body interior 112, it continuously loses energy through friction and wind resistance, causing each oscillation to be smaller than the previous oscillation. Eventually, the central magnet 202 loses enough energy such that the oscillations stop completely, and the central magnet comes back to rest at the midpoint between end magnets 208*a* and 208*b* as depicted in FIG. 5A. The number of oscillations will depend on several factors, including the initial acceleration of the firearm it is fired, the mass of the central magnet 202, the magnetic strength of the central magnet, the magnetic strength of the end magnets 208, and the amount of friction the central magnet experiences as it moves through the cylindrical body interior 112. In some embodiments, the central magnet 202 may oscillate back and forth multiple times before coming to rest, while in other embodiments, the central magnet may come to rest after only one oscillation.

Figure 6A:
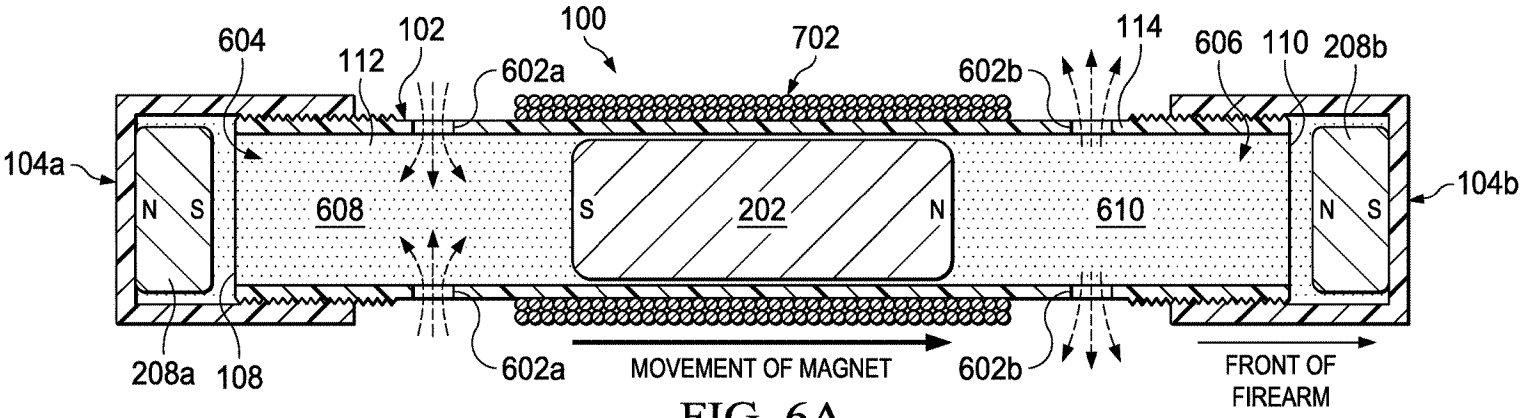
FIGS. 6A-6C illustrate cross-section side views of an embodiment of an anti-recoil device which includes air vents during operation of the device.
Figure 6B:
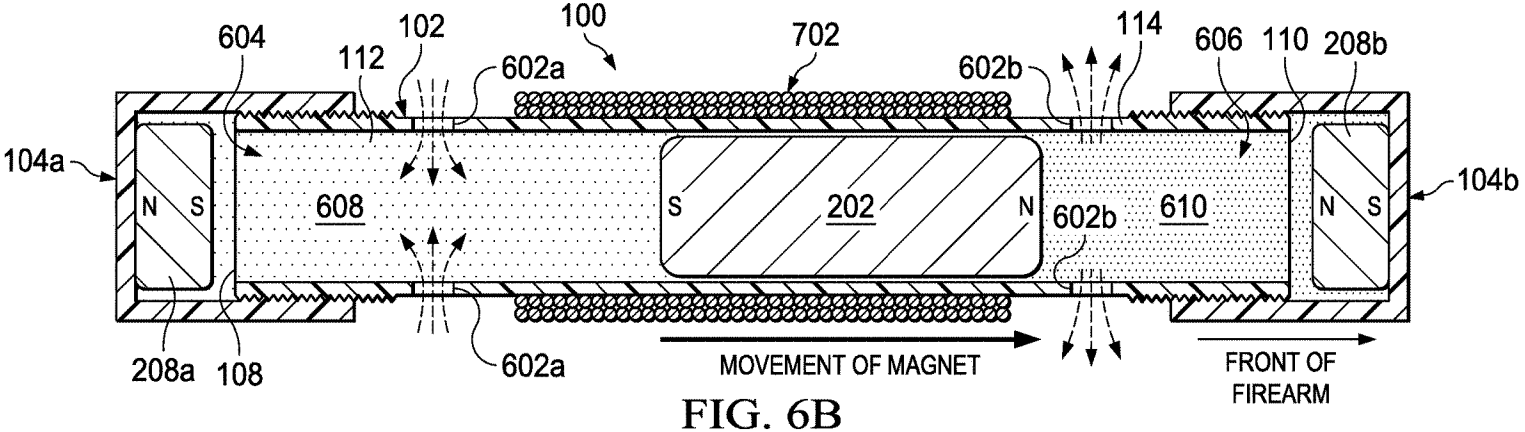
Figure 6C:
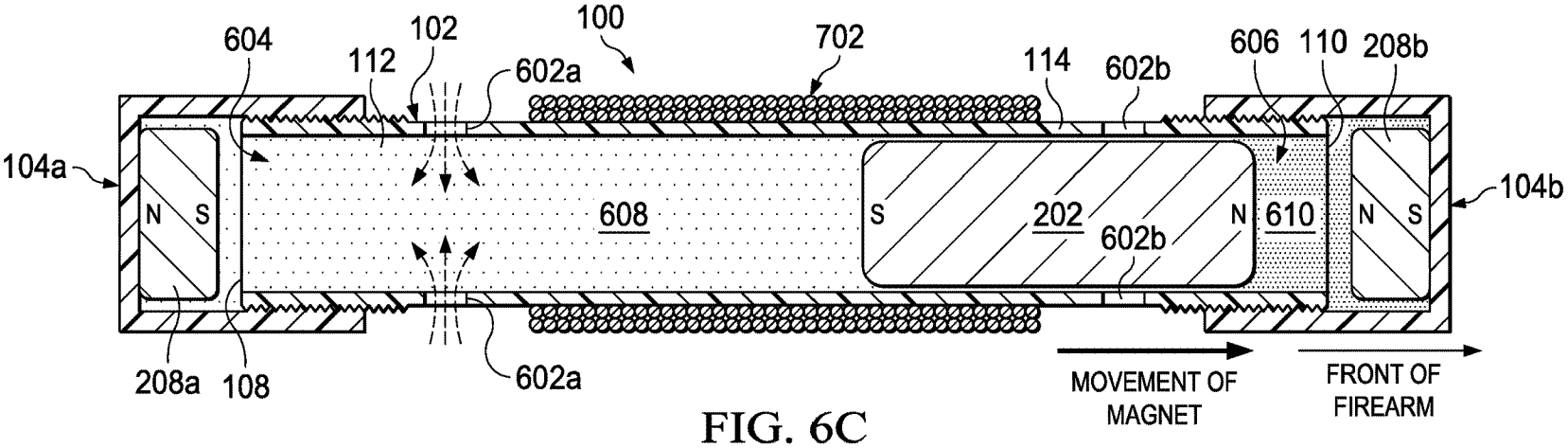

Referring now to FIGS. 6A-C, there is illustrated an embodiment which includes vents which create an air cushion within the anti-recoil device 100. Referring first to FIG. 6A, there is illustrated a cross section side view of an embodiment of an anti-recoil device 100 that includes air vents 602, which adds an "air cushion" effect to the anti-recoil device. The embodiment depicted in FIG. 6A includes the central magnet 202 and the end magnets 208 as described hereinabove with respect to FIGS. 5A-F. FIG. 6A also includes air vents 602, which are small holes in the cylindrical body wall 114. The embodiment depicted in FIG. 6A includes two sets of air vents: one set of air vents 602*a* near one end 108 of the cylindrical body, and another set of air vents 602*b* near the other end 110 of the cylindrical body. Each set of air vents 602 is near one of the cylindrical body ends 108, 110, but the air vents are not covered or blocked by the end cap walls 124. In other words, there is a clear path for air to move between the cylindrical body interior 112 through the air vents 602 to the exterior of the anti-recoil device 100. In the embodiment depicted in FIG. 6A, the central magnet 202 forms a complete or substantially complete air boundary with the cylindrical body wall 114 within the cylindrical body interior 112 such that air is prevented or substantially impeded from moving past the central magnet from the body interior portion 604 at one end of the central magnet to the body interior portion 606 at the other end of the central magnet.

The operation of the embodiment depicted in FIG. 6A includes all of the steps and actions associated with the interaction of magnetic forces as described hereinabove with respect to FIGS. 5A-F. Thus, for ease of understanding, the effects caused by magnetic forces, while they are present, will not be discussed with respect to FIG. 6A-C. The process begins when the firearm is fired, and, as depicted in FIG. 6A, the central magnet 202 a sudden velocity change in the direction of the front of the firearm, that is, toward end magnet 208*b*. In reality, the central magnet stays still, while the rest of the anti-recoil device 100 moves backward in a direction opposite of the front of the gun, but, as described hereinabove, for ease of understanding, this process will be described with respect to a "body-fixed" reference frame wherein the central magnet 202 moves, and the rest of the anti-recoil device 100 stays still. As the central magnet 202 beings to move in the direction of the front of the firearm, the body interior portion 604 (whose boundaries are formed by the cylindrical body wall 114, the interior of the endcap 104*a*, and the end of the central magnet nearest the endcap 104*a*) begins to increase in volume. To account for the increased volume of body interior portion 604, air 608 is sucked into the body interior portion 604 from the exterior of the anti-recoil device through the air vents 602*a*. At the same time, the body interior portion 606 (whose boundaries are formed by the cylindrical body wall 114, the interior of the endcap 104*b*, and the end of the central magnet nearest the endcap 104*b*) begins to decrease in volume. This decrease in volume causes air 610 within the body interior portion 606 to be forced out through the air vents 602*b* to the exterior of the device 100.

Turning to FIG. 6B, there is illustrated a cross section side view of the embodiment of an anti-recoil device 100 as depicted in FIG. 6A. At this stage of operation, after that described hereinabove with respect to FIG. 6A, the central magnet 202 is continuing to move in the direction of the front of the firearm. The continued movement of the central magnet 202 in the direction of the front of the firearm causes the volume of the interior portion 604 to continue to increase, drawing in more air 608 from the exterior of the anti-recoil device 100 through air vents 602*a*. At the same time, the volume of the interior portion 606 continues to decrease as a result of the central magnet moving in the direction of the front of the firearm. This continued decreasing volume of interior portion 606 continues to force air 610 out from the interior portion 606 through the air vents 602*b* to the exterior of the anti-recoil device 100.

Turning next to FIG. 6C, there is illustrated a cross section side view of the embodiment of an anti-recoil device 100 as depicted in FIGS. 6A-B. At this stage of operation after that described hereinabove with respect to FIG. 6B, the central magnet 202 has continued moving toward the direction of the front of the firearm. At the stage of FIG. 6C, however, the central magnet 202 has moved so far forward within the cylindrical body interior 112, that the central magnet covers the set of air vents 602*b* closest to end 110, creating an air-tight (or near air-tight) seal between the interior portion 606 and the exterior of the anti-recoil device 100, blocking the movement of air 610 from the interior portion 606 to the exterior of the anti-recoil device. It is at this point that the "air cushion" effect beings to occur. As the central magnet 202 continues to move past the air vents 602*b*, the volume of the interior portion 606 continues to decrease. Since the air 610 cannot escape through the vents 602*b*, the decreased volume of interior portion 606 results in an increased pressure (as compared to the pressure of the air 608) of the air 610 trapped within interior portion 606. This increased pressure results in a net force on the central magnet 202 in the direction away from the front of the firearm, helping (along with the magnetic forces as described hereinabove with respect to FIGS. 5A-F) to slow the movement of the central magnet. As the central magnet 202 continues to move forward (albeit at a continuously lower velocity), the volume of interior portion 606 continues to decrease, and the pressure of the air 610 continues to increase, resulting in a rearward force on the central magnet that increases as the central magnet continues to move forward. Eventually, the force of the pressure from air 610, along with the magnetic forces as described hereinabove with respect to FIGS. 5A-F, causes the central magnet 202 to stop moving forward and begin to move backwards within body interior 112. If the central magnet 202 has enough momentum to continue moving backward though body interior 112 to the point where the central magnet blocks air vents 602*a*, then the air 608 within interior portion 604 will act as a cushion and exert a force on the central magnet in the forward direction until its movement is stopped and reversed again.

The embodiment illustrated in FIGS. 6A-C includes two sets of air vents 602, with each set having two air vents 602. Other embodiments will have different numbers of air vents 602. For example, in some embodiments, there is only one air vent 602*a* and one air vent 602*b*. In other embodiments, there are three each of air vents 602*a* and 602*b*. In some embodiments, the central magnet 202 will create a near perfect seal between with the cylindrical body wall 114, while in other embodiments, the tolerances will be looser, and some amount of air will still be able to move between the interior portion 606 (or the interior portion 604) and the exterior of the anti-recoil device 100, even with the central magnet 202 blocking the respective air vents 602.

Figure 7C:
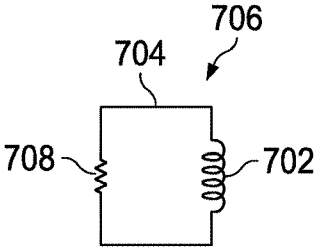
FIGS. 7B-7C are schematic illustrations of different coils which can be included in embodiments of an anti-recoil device.
Figure 7B:
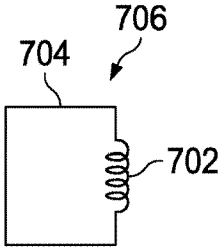
Figure 7A:
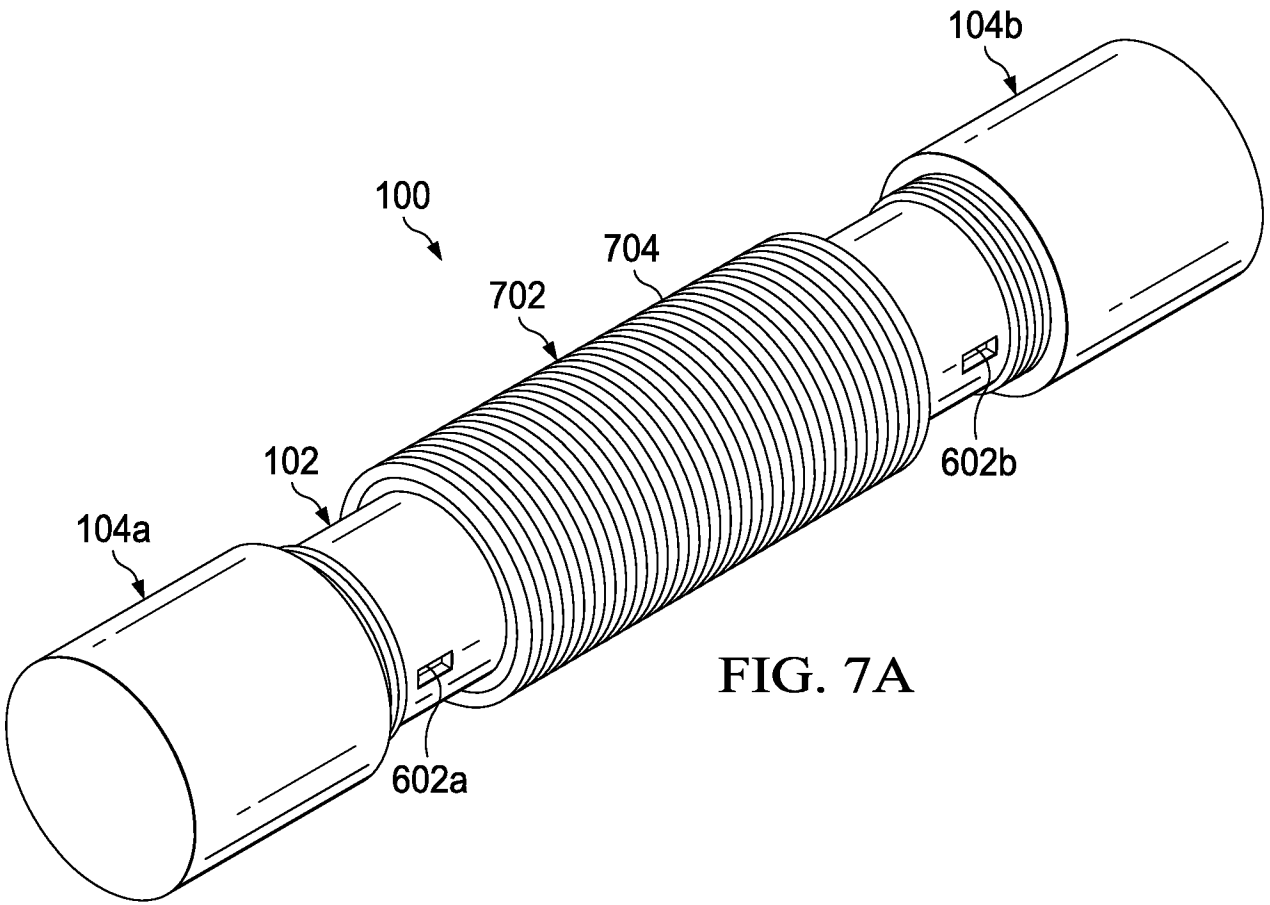
FIG. 7A illustrates a perspective view of an embodiment of an anti-recoil device which includes a coil.

Turning now to FIG. 7A, there is illustrated a perspective view of another embodiment of an anti-recoil device. In this embodiment, the anti-recoil device 100 includes an electromagnetic coil 702 wrapped around the outside of the cylindrical body 102. The inclusion of an electromagnetic coil 702 around the cylindrical body 102 of the anti-recoil device 100 means that an electromotive force and a current are induced in the wire of the coil as the central magnet 202 moves back and forth within the cylindrical body interior 112. This induced current creates a counteracting magnetic field via a reverse motional electromotive force (EMF) whose force on the central magnet 202 (and on the coil 702) resists the movement of the central magnet and helps counteract the force of the recoil of the firearm. In the embodiment illustrated in FIG. 7A, the electromagnetic coil 702 is made of a long strand of magnet wire 704 which is wound numerous times around the outside of the cylindrical body 102. The ends of the magnet wire 704 are electrically connected together to form a circuit in which current can flow.

Turning now to FIG. 7B, there is illustrated a schematic illustration of the coil 702 in some embodiments. In these embodiments, a complete circuit 706 is created by connecting the ends of the wire 704 that form the coil 702.

Turning to FIG. 7C, there is illustrated a schematic illustration of the coil 702 in other embodiments. In these embodiments, a complete circuit 706 is completed by connecting a resistor or resistors 708 in series with the wire 704 which makes up the coil 702. The addition of a resistor 708 changes the properties of the coil 702 and how it affects the central magnet 202.

Figure 8A:
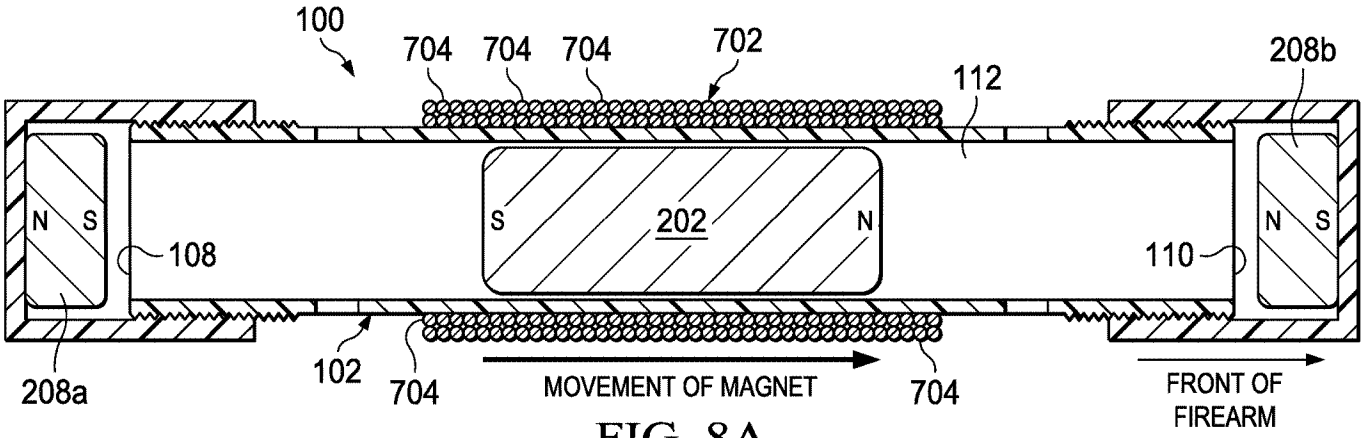
FIGS. 8A-8C illustrate cross-section side views of an embodiment of an anti-recoil device which includes a coil during operation of the anti-recoil device.
Figure 8B:
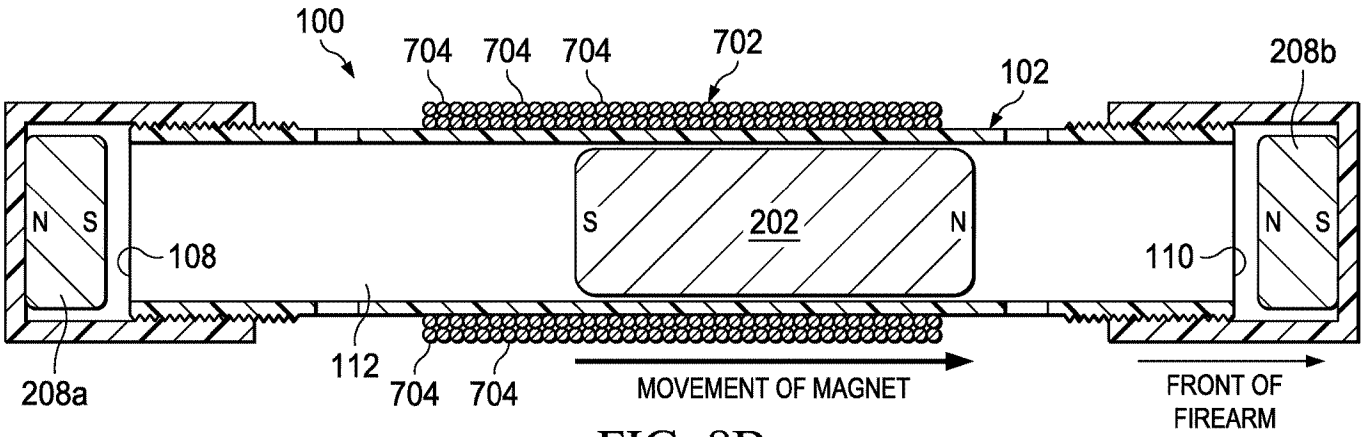
Figure 8C:
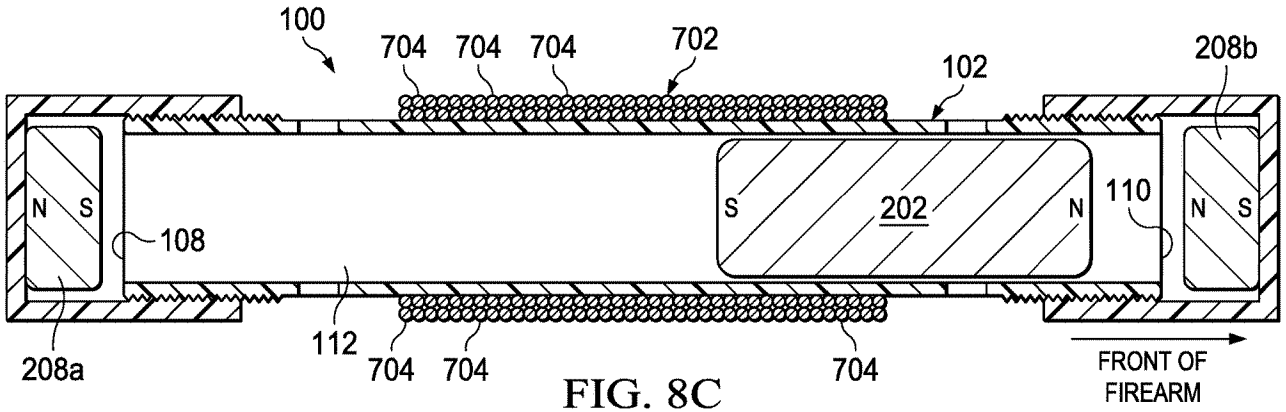

Referring now to FIGS. 8A-C, there are illustrated cross section views of the embodiment depicted in FIG. 7A of an anti-recoil device 100 which includes an electromagnetic coil 702. It will be understood that the embodiment illustrated in FIGS. 7-8 include the central magnet 202 and the end magnets 208 as described hereinabove with respect to FIGS. 5A-F. Thus, for ease of understandability, the effects of the central magnet 202 and end magnets 208, to the extent that they are the same as described hereinabove with respect to FIGS. 5A-F, will not be described again with respect to FIGS. 8A-C.

Turning to FIG. 8A, there is illustrated the embodiment of the anti-recoil device 100 with an electromagnetic coil 702 as depicted in FIG. 7A. The electromagnetic coil 702 is made of numerous winds of a magnetic wire 704. The ends of the magnetic wire 704 are electrically connected to each other so that a current can flow through the magnetic wire in a complete circuit. In FIG. 8A, which illustrates the state of the anti-recoil device 100 immediately after the firearm is fired, the central magnet 202 has a high forward velocity (relative to the rest of the anti-recoil device) in the direction of the front of the firearm (towards end 110). As the central magnet begins to move though the cylindrical body interior 112, it also moves through the interior, or core, of the magnetic coil 702. As the central magnet 202 moves through the core of the magnetic coil 702, a current is induced in the magnetic coil, which in turn creates a magnetic field opposing the movement of the central magnet. This results in a force on the central magnet 202 in the direction backwards away from the front of the firearm and a force on the magnetic coil 702, and the cylindrical body 102 to which the magnetic coil is attached, forward towards the front of the firearm. This force, along with the other forces described hereinabove with respect to FIGS. 5A-F, begins to slow the forward movement of the central magnet 202.

Turning next to FIG. 8B, there is illustrated a cross section side view of the embodiment of an anti-recoil device 100 depicted in FIG. 8A. At this stage of the operation of the anti-recoil device 100, the central magnet 202 continues to move in the direction of the front of the firearm. The induced current generated by the movement of the central magnet 202 through the central body interior 112, which is the core of the magnetic coil 702, continues to increase in strength as the central magnet continues to move. The increase in induced current causes an increase in the induced magnetic field which results in an increase in the force opposing the forward movement of the central magnet 202. This increasing magnetic force continues to slow the movement of the central magnet 202 at an increasing rate.

Turning next to FIG. 8C, there is illustrated a cross section side view of the embodiment of an anti-recoil device 100 depicted in FIGS. 8A-B. At this stage in the operation of the anti-recoil device 100, the central magnet 202 has slowed to a stop (its velocity in the direction towards the front of the firearm has been reduced to nothing). This is due in part to the motional EMF of the magnetic field created as a result of the current induced by the movement of the central magnet 202 through the magnetic coil 702. Even though the central magnet 202 has come to a stop, the magnetic force created by the induced current will continue to push the central magnet backwards away from the front of the firearm for some finite time while the induced current diminishes. At the same time, other forces on the central magnet 202, as described hereinabove with respect to FIGS. 5A-F, will push the central magnet backwards, giving it a velocity within the cylindrical body interior 112 in the direction away from the front of the firearm. At this time, the movement of the central magnet 202 through the body interior 112 will induce a current in the magnetic coil 702 flowing in the opposite direction as before, creating a magnetic field which will now exert a force on the central magnet opposing its movement away from the front of the firearm.

The movement of the central magnet 202 will continue oscillating back and forth within the cylindrical body interior 112 as described hereinabove with respect to FIGS. 8A-C. The induced magnetic fields will oppose, via the opposing motional EMF, the movement of the central magnet 202, and, along with other forces such as friction and wind resistance, will force the central magnet to come to rest, similar to as described hereinabove with respect to FIGS. 5A-5F.

In the embodiment illustrated in FIGS. 7A and 8A-C, the magnetic coil 702 was made of magnetic wire 704 wrapped around the cylindrical body 102 in two layers. Other embodiments will have magnetic coils 702 made of different material and in different configurations. For example, some embodiments will have between 750 and 850 winds in the coil 702. Other embodiments will have different number of winds in the coil 702. Some embodiments will use 28 gauge magnet wire 704, while other embodiments will have different thicknesses of wire or other conductive material which makes the coil 702. Different embodiments will have different resistivity of the material of the magnetic coil. Some embodiments will have a magnetic coil 702 that is "tuned" such that the induced current will rise or fall with a time constant of between 100 μs and 2 ms to optimize the magnetic forces exerted on the central magnet 202 by the coil. The magnet wire 704 may be made of any appropriate material. In some embodiments, the magnet wire 704 is made of copper. In other embodiments, the magnet wire 704 is made of aluminum.

Figure 9:
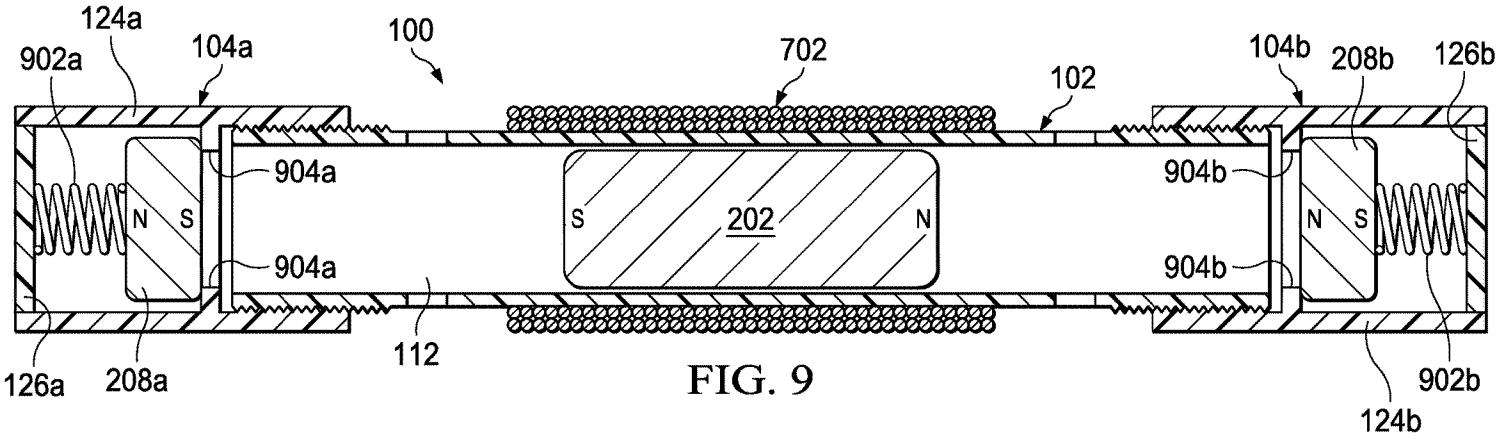
FIG. 9 illustrates a cross-section side view of an embodiment of an anti-recoil device which includes springs on the end magnets.

Referring now to FIG. 9, there is illustrated a cross section side view of another embodiment of an anti-recoil device which includes interchangeable springs and end magnets. Some owners of the anti-recoil device will want to use the device in different firearms. Different firearms often experience different amounts of recoil force when fired. It is useful to be able to adjust the strength and mass of the end magnets, or even to add springs to the device, to account for the differing recoil force levels between different firearms. Referring back to FIG. 9, there is illustrated an embodiment of an anti-recoil device 100 that includes a central magnet 202 and two end magnets 208*a*, 208*b*, similar to the embodiment described hereinabove with respect to FIGS. 1-2. The embodiment of FIG. 9, however, also includes springs 902*a*, 902*b*. The end magnets 208*a*, 208*b*, rather than being affixed to the end caps 104*a*, 104*b*, are held in place within the end caps 104*a*, 104, by springs 902*a*, 902*b*. Each spring 902 (one within each end cap 208*a*, 208*b*) is held under tension between the end cap end wall 126 and the end magnet 208. The spring 902 presses the end cap 208 against a lip 904 within the end cap 104. The lip 904 prevents the end magnet 208 from being forced out of the end cap 104 by the spring 902, but allows the end magnet to move farther back into the end cap if pushed hard enough by the magnetic forces from the central magnet 202. The inclusion of the spring 902 and the moveable end magnet 208 within each end cap 104*a*, 104*b* add extra "cushion" to absorb recoil force from the movement of the central magnet 202. The end magnet 208 being able to move within the end cap 104 also adds some protection to the anti-recoil device 100. For example, if the anti-recoil device 100 experiences a particularly high recoil force, then the central magnet 202 will move towards the end magnet 208 with a higher than normal speed. As the central magnet 202 nears the end magnet 208, the some of the shock of the recoil will be absorbed by the end magnet pushing back against the spring 902 and moving into the end cap 104, giving the central magnet a bit of extra length of space within the cylindrical body interior 112 to travel before it would impact the end magnet 208.

In some embodiments, the springs 902 and/or the end magnets 208 within the end caps 104 are interchangeable. In these embodiments, the end cap end wall 126 is a separate piece from the end cap side wall 124. The end cap end wall 126 is removable from the end cap side wall 124 and has threads on its edge which threadably engage with the end cap side wall 124, which also has threads. By removing the end cap end wall 126, the spring 902 and the end magnet can be removed from the end cap 104. The springs 902 can then be replaced with springs of greater or lesser stiffness. The end magnets 208 can be replaced with magnets of greater or lesser magnetic strength and/or greater or lesser mass. These changes will affect how much shock force the anti-recoil device 100 can absorb and how "stiff" the device feels to the operator when used in a firearm. Thus, the springs 902 and end magnets 208 can be swapped for different versions in order to customize the anti-recoil device to the user's personal preferences.

Figure 10A:
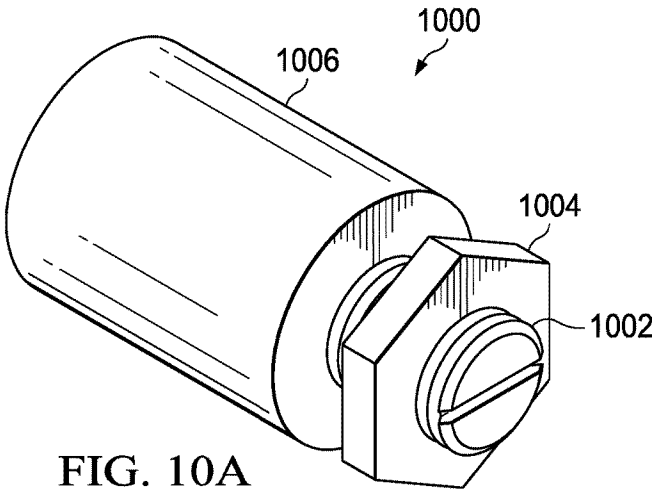
FIG. 10A illustrates a perspective view of an adjustable spacer assembly.
Figure 10B:
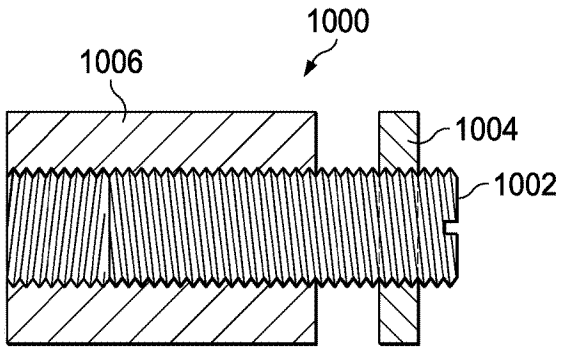
FIG. 10B illustrates a cross-section side view of a spacer assembly.
Figure 10C:
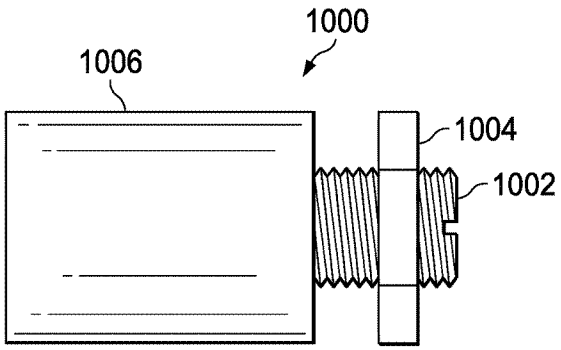
FIG. 10C illustrates a side view of a spacer assembly.

Turning now to FIGS. 10A-C, there is illustrated an adjustable spacer assembly for embodiments of an anti-recoil device 100 which include an adjustable spacer assembly. As described hereinabove with respect to FIGS. 3-4, the anti-recoil device 100 is installed within the bolt hole 304 of a firearm for operation. While many firearms have a bolt hole 304 that is of a standard length, some firearms will have a bolt hole that is longer than standard. For these firearms, the anti-recoil device 100 includes a spacer assembly which is installed in the bolt hole 304 with the rest of the anti-recoil device. The spacer assembly takes up the extra space within the bolt hole 304 so that the anti-recoil device 100 is held firmly within the bolt hole and there is no play for the anti-recoil device to move back and forth within the bolt hole when the firearm is fired.

Referring back to FIG. 10A, there is illustrated a perspective view of an embodiment of a spacer assembly 1000. The spacer assembly 1000 includes a center screw 1002, a locking nut 1004, and a round nut 1006. The center screw 1002 is a cylindrical screw that has threads which allow it threadebly engage with the round nut 1006. The round nut 1006 is a cylindrical body with flat ends and a threaded hollow cylindrical core running the length of the round nut. The diameter of the hollow core of the round nut 1006 is such that the threads of the center screw 1002 can engage with the treads of the hollow core. At least one end of the hollow core of the round nut 1006 is exposed such that the center screw 1002 can be at least partially screwed into the hollow core. The locking nut 1004 is a nut that is threaded and sized such that it can be screwed onto the center screw 1002. In the embodiment illustrated in FIG. 10A, the locking nut 1004 is an ordinary hex nut.

To configure the spacer assembly 1000 to be the correct length, the center screw 1002 is partially screwed into the round nut 1006. The amount of the center screw 1002 that is screwed into the round nut 1006 depends on how much extra room is left in the bolt hole 304 of the firearm once the rest of the anti-recoil device 100 is installed. The center screw 1002 is turned one way or the other until the total length of the spacer assembly 1000, that is, the length round nut 1006 with part of the center screw 1002 protruding from its hollow core, is the same length as the extra length of bolt hole 304.

Turning next to FIG. 10B, there is illustrated a cross section side view of the spacer assembly 1000, with the center screw 1002 partially screwed into the round nut 1006, and the locking nut 1004 screwed onto to the center screw.

Turning next to FIG. 10C, there is illustrated a side view of the spacer assembly 1000, with the center screw 1002 partially screwed into the round nut 1006, and the locking nut 1004 screwed onto to the center screw.

Figure 11A:
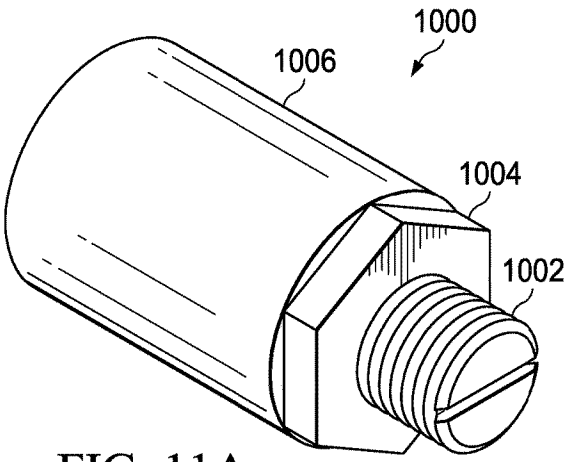
FIG. 11A illustrates a perspective view of a spacer assembly.
Figure 11B:
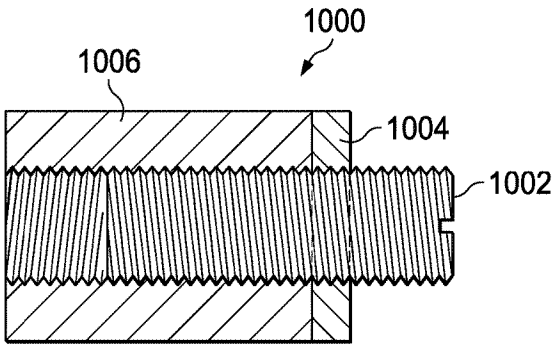
FIG. 11B illustrates a cross-section side view of a spacer assembly.
Figure 11C:
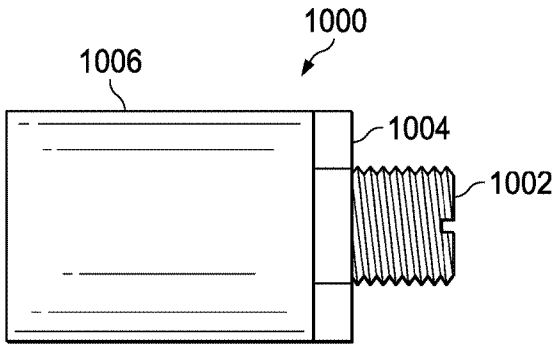
FIG. 11C illustrates a side view of a spacer assembly.

Referring next to FIGS. 11A-C, there are illustrated views of an embodiment of the spacer assembly 1000 as illustrated in FIGS. 10A-C in its locked configuration. Turning to FIG. 11A, there is illustrated a perspective view of the spacer assembly 1000. Once the appropriate length of the center screw 1002 is screwed into the round nut 1006 such that the spacer assembly 1000 is the correct length to take up the extra room in the bold hole 304, the locking nut 1004 is tightened onto the center screw against the round nut 1006. When the locking nut 1004 is tightened against the round nut 1006, there will be increased friction between the end of the round nut and the face of locking nut. The threads of the locking nut 1006 will also be forced tightly against the threads of the center screw 1002, resulting in increased friction between the treads of the locking nut and the center screw. The result of the increased friction between the locking nut 1004 and the face round nut 1006 and between the locking nut and the center screw 1002 is that the center screw will be harder to screw in or out of the round nut. This, in effect, freezes the length of the spacer assembly 1000 and prevents vibrations and recoil shocks from shaking the center screw 1002 enough of gradually change the length of the spacer assembly, which could result in the spacer assembly not working effectively and reducing the overall effectiveness of the anti-recoil device 100 as a whole.

Figure 12A:
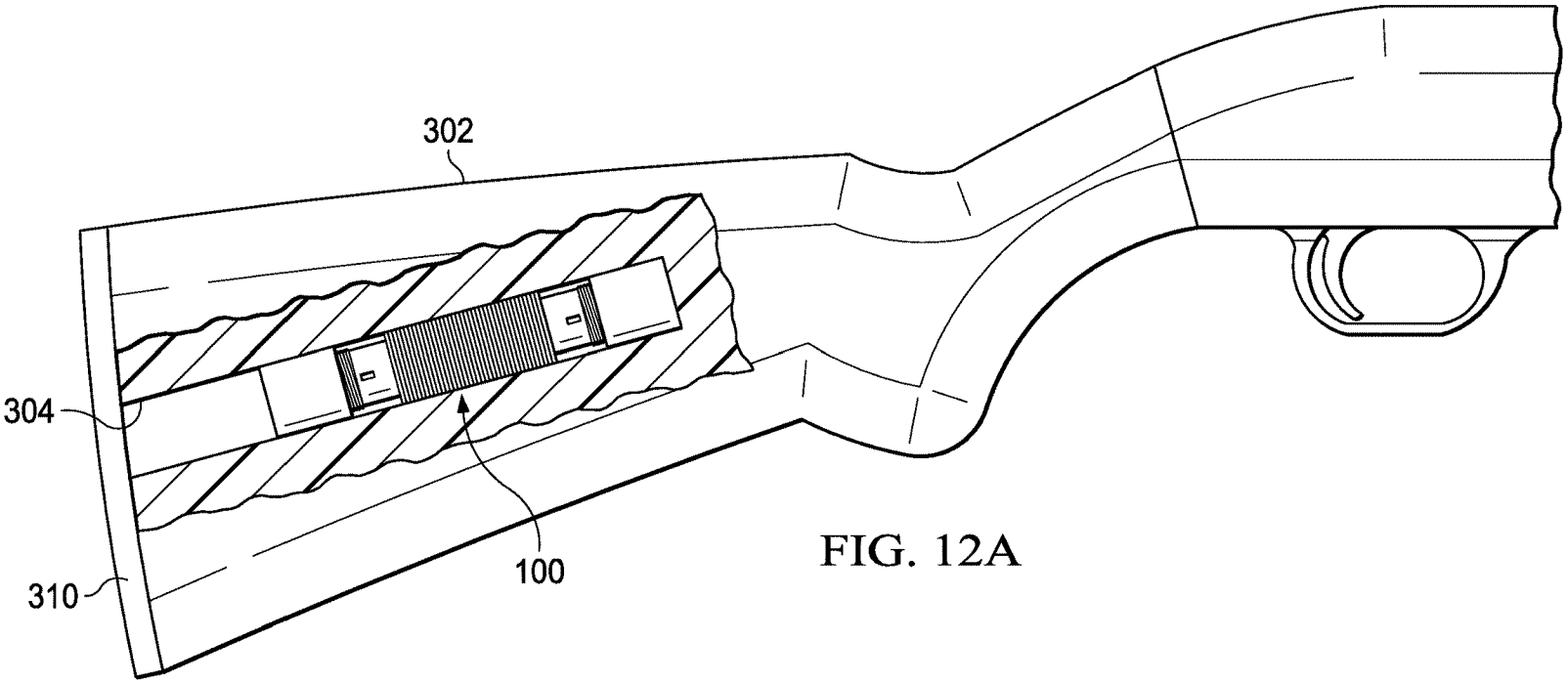
FIG. 12A illustrates a cut-away side view of an anti-recoil device in the bolt hole of a stock of a firearm.

Referring to FIG. 12A, there is illustrated a cut-away side view of an anti-recoil device 100 installed in the stock 302 of a firearm in which the bolt hole 304 is longer than the anti-recoil device 100 without a spacer assembly 1000.

Figure 12B:
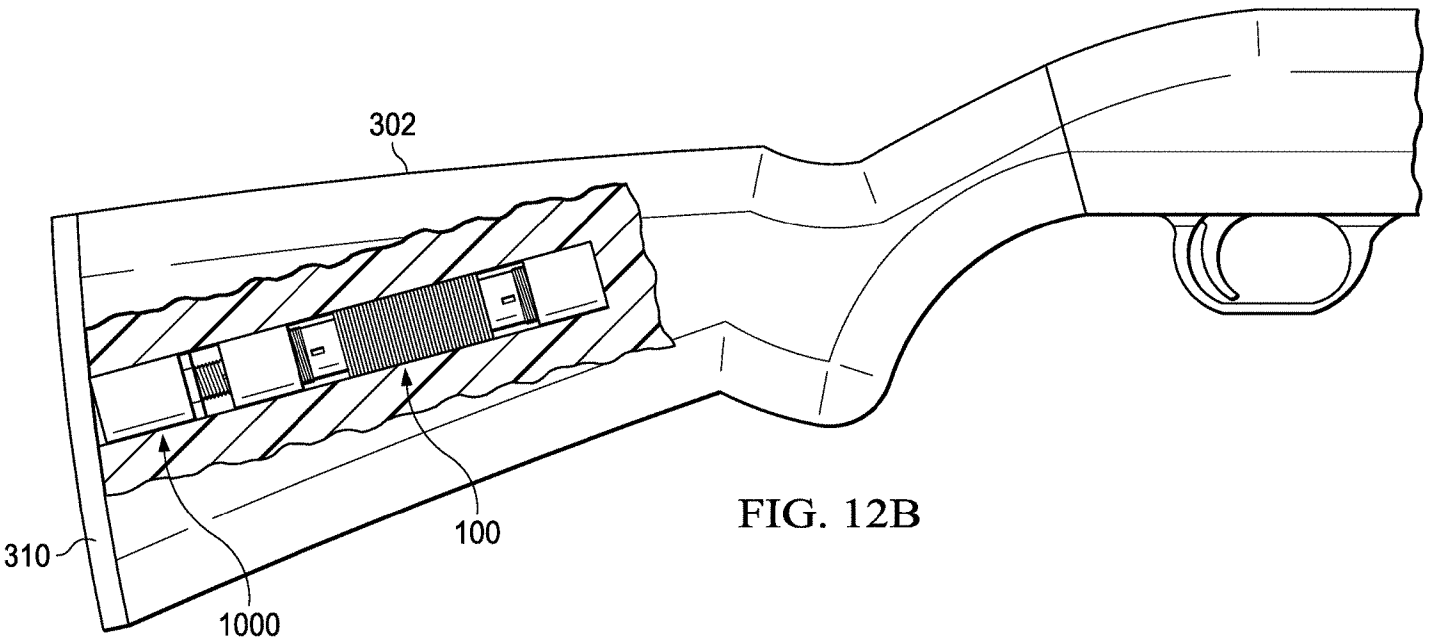
FIG. 12B illustrates a cut-away side view of an embodiment of an anti-recoil device with a spacer assembly installed in the bolt hole of a sock of a firearm.

Referring next to FIG. 12B, there is illustrated a cut-away side view of an anti-recoil device 100 installed in the stock 302 of a firearm in which the bolt hole 304 is longer than the anti-recoil device 100 without a spacer assembly 1000. The embodiment of anti-recoil device 100 illustrated in FIG. 12B, however, also includes a spacer assembly 1000. To correctly install an anti-recoil device 100 in a bolt hole 304 that is longer than the cylindrical body 102 and end caps 104, the spacer assembly 1000 is adjusted to be the length of the extra space within the bolt hole and is then simply placed in the bolt hole along with the rest of the anti-recoil device. The rest of the installation process is the same as is described hereinabove with respect to FIG. 4.

Figure 13:
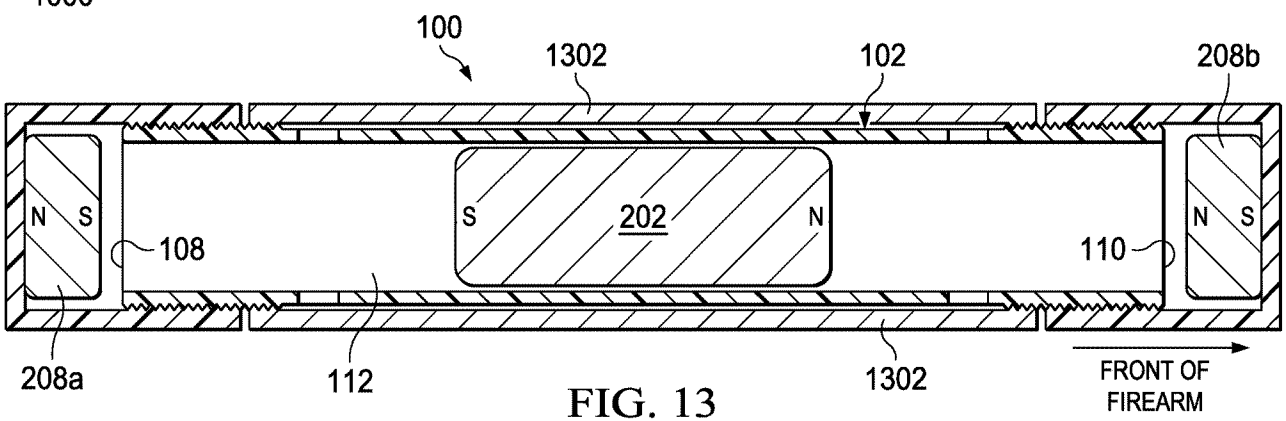
FIG. 13 illustrates a cross-section side view of an embodiment of an anti-recoil device which includes a metal tube.

Turning now to FIG. 13, there is illustrated an embodiment of an anti-recoil device which includes a metal tube. In this embodiment, the anti-recoil device 100 includes a metal tube 1302 around the outside of the cylindrical body 102. The metal tube 1302 may be fixed with respect to and around the cylindrical body 102. The metal tube 1302 serves the same purpose as the magnetic coil 702 described hereinabove with respect to embodiments which include magnetic coils. When the firearm is fired, the central magnet 202 moves within the body interior 112 (and, thus, within the core of the metal tube 1302) and induces a current within the metal tube, which in turn creates a magnetic field opposing the movement of the central magnet. This results in a force on the central magnet 202 in the direction backwards away from the front of the firearm and a force on the metal tube 1302, and the cylindrical body 102 to which the metal tube is attached, forward towards the front of the firearm.

The metal tube 1302 can be fixed in place a number of ways, such as with an adhesive, a friction fit, a fastener or fasteners, or by being secured in place by the end caps 104. The metal tube 1302 may be made of a variety of appropriate materials. In some embodiments, the metal tube 1302 is made of copper, while in some embodiments, the metal tube is made of aluminum. In some embodiments, the metal tube 1302 has vent holes which line up with air vents 602 (for some embodiments which include air vents). In other embodiments with air vents 602, the length of the metal tube 1302 is specified such that the metal tube does not cover the air vents. In other embodiments with air vents 602, the metal tube 1302 may simply be loose enough around the air vents so as to not block the movement of air in and out of the air vents.

It will be understood that features of each of the various embodiments may be used alone or in combination with features of other embodiments. For example, some embodiments will have the central magnet 202 and end magnets 208 as described hereinabove with respect to FIG. 2 and also have the air vents 602 as described hereinabove with respect to FIGS. 6A-C. Other embodiments will have the central magnet 202 and end magnets 208 as well as the coil 702 as described hereinabove with respect to FIGS. 7 and 8A-C. Still other embodiments will include the central magnet 202 and end magnets 208, the coil 702, the air vents 602, and the spacer assembly 1000 as described hereinabove with respect to FIGS. 10-12.

For added understanding of the disclosure, the description hereinbelow gives a more mathematical scientific explanation of the operation of the anti-recoil device 100.

The primary recoil forces involved in shooting, for example, a shotgun depend on the mass of the shotgun being fired, the mass of the ejecta (mass of the wad+the mass of the shot), and the velocity of the ejecta. When a shotgun shell is fired, the force created by the expanding gasses of the gunpowder push the ejecta down the barrel and out of the gun. As this motion is along a straight line, physics defines this as linear momentum, and is described mathematically by the formula:

$p_e=m_e v_e$, where $p_e$=momentum of the ejecta in kg·m/s, $m_e$=mass of the ejecta in kg, and $v_e$=velocity of the ejecta in m/s.

For an example 1200 fps, 1.125 oz. shell:

1200 f/s=365.76 m/s, 1.125 oz.=0.031893214 kg+(for the wad about 33 grains or) 0.002 kg, and $p_e$=365.76 m/s*0.034 kg=12.44 kg·m/s.

By Newton's 3rd law, that same force works in the opposite direction against the mass of the shotgun. Thus, $p_g=-p_e$, or $m_g v_g=-m_e v_e$, where $p_g$=momentum of the gun in kg m/s, $m_g$=mass of the gun in kg, and $v_g$=velocity of the gun in m/s.

For an example shotgun of 8 pounds (or 3.8 kg):

$v_g$=−12.44 kg·m/s/3.8 kg=−3.27 m/s.

If the length of the barrel in this example shotgun is 30 inches (0.762 meters) and the ejecta is traveling at 1200 fps (365.76 m/s), then the primary recoil event lasts a time calculated by the following:

0.762 m/365.76 m/s=0.002 s (or 2 ms).

The average acceleration over this interval is 3.27 m/s/0.002 s=1635 m/s$^2$. Using force=mass×acceleration, the primary recoil force is calculated as:

$F$=3.8 kg*1635 m/s$^2$=6213 kg·m/s$^2$ or 6213 N.

The recoil of a gun is composed of two recoil events. What is described hereinabove above is known as primary recoil and is due to the forces involved in pushing the ejecta down the barrel and out of the gun.

The Anti Recoil Device (ARD) 100 reduces primary recoil due to the force of recoil pushing against the mass of the central magnet 202 weight, thus imparting kinetic energy (motion) to the central magnet 202. This action also "compresses" the forward "magnetic spring," and decompresses the rear "magnetic spring," setting the central magnet into oscillation along the line of the recoil force, between the forward and rearward "magnetic springs."

There is a secondary recoil event due to the rocket engine like effect of gasses leaving the barrel after the ejecta has left the barrel. The forces of the secondary recoil are dependent on many factors, including the specific characteristics of the gunpowder that is used. Because of these variables, it is difficult to generalize measurements of forces of the secondary recoil event (shells of the same speed and load can produce different results), but it can be measured for a specific test instance (a specific gun with a specific shell in specific conditions).

An important point about secondary recoil is that it happens after the primary recoil, and generally lasts a longer period of time. The secondary recoil imparts more energy into the central magnet 202. For a central magnet 202 of 0.5 in diameter by 2 inches long, the mass of the central magnet, which is used to calculate the force on the central magnet, is calculated by:

Volume=$\pi r^2 h$=>3.14*0.635 cm*0.635 cm*5.08 cm=6.43 cm$^3$, and

Mass of the center magnet weight=6.43 cm$^3$*7.4 g/cm$^3$=47.582 g=0.047 kg.

The primary recoil force is calculated by:

$F=ma$=0.047 kg*1635 m/s$^2$=76.8 kg m/s$^2$ or 76.8N.

The secondary recoil force is calculated by:

Assuming ¾" (0.01905 m) displacement of weight over 0.01 s,

Avg velocity=0.01905 m/0.01 s)=1.905 m/s, $p_w=m_W v_w$=0.047 kg*1.905 m/s=0.0895 kg·m/s, Avg acceleration=1.905 m/s/0.01s=190.5 m/s, and $F=ma$=0.047 kg*190.5 m/s$^2$=8.95 kg·m/s$^2$=8.95N.

The kinetic energy of the oscillating central magnet 202 is converted to Electromotive Force (EMF) by the magnetic flux of the oscillating central magnet in the presence of a coil 702. These forces are calculated using the following variables:

$V_{EMF}=-N(\Delta(BA)/\Delta t)$ $V_{EMF}$=voltage

N=number of turns in the coil

B=magnetic field strength (in Tesla) through the coil

A=Area of the coil (in meters)

t=time (in seconds).

For example, given:

$\Delta B/\Delta t$=0.14T/0.01s=14T/s, $N$=800, $A=2\pi rh$=2*3.14*0.0079*0.0508=0.0025 m$^2$, and $V_{EMF}$=−800*0.0025*14=−28 V.

EMF is working against the direction of movement of the central magnet 202. EMF damps the oscillation and vibration of the central magnet 202. Convert EMF (voltage) to Power (watts)=$V^2/R=28^2/100$=7.84 W. The electrical power (watts) is converted to heat.

With either analysis, the central magnet 202 will "bounce" a couple of times until frictional forces and EMF have transformed the kinetic energy into heat, and the central magnet 202 returns to magnetic balance between the end magnets.

The total electrical power generated by the transducer described by a harmonic series or can be approximated by a sequence with n=3 or 4. While the current will change direction with the oscillation of the central magnet 202 (positive and negative elements of the series), of interest is the magnitude of the EMF.

Using the example figures above:

$\text{Power}_{Xducer}=\Sigma_{i=1\ to\ 4}\{(800*0.0025*14/i)^2/R\}$=11.2W.

The force of recoil is reduced by the amount of force required to move the mass of the central magnet 202+the EMF that is created by the magnetic flux of the oscillating central magnet weight in the presence of the electrical coil 702+frictional forces, until the central magnet weight eventually returns to its original steady state position.

It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. An anti-recoil device for being inserted in the stock of a firearm, comprising:

a cylindrical tube having a hollow core with first and second ends and a longitudinal axis;

a first end magnet disposed in a portion of the first end of the core and oriented in a first magnetic direction with the poles aligned with the longitudinal axis;

a second end magnet disposed in a portion of the second end of the core and oriented in the first magnetic direction;

a reciprocating magnet disposed in a central portion of the core between the first and second ends of the core and movable between the first and second ends and first and second end magnets and oriented in a second magnetic direction opposing the first magnetic direction; and a metal tube disposed about and adjacent the cylindrical tube to produce a reverse EMF when the reciprocating magnet reciprocates.

2. The anti-recoil device of claim 1, wherein the reciprocating magnet is cylindrical.

3. The anti-recoil device of claim 2, wherein the reciprocating magnet has a diameter substantially equal to the diameter of the core.

4. The anti-recoil device of claim 1, wherein the metal tube is made of copper.

5. The anti-recoil device of claim 1, wherein the metal tube is made of aluminum.

6. The anti-recoil device of claim 1, wherein the cylindrical tube is made of a smooth material with low friction between the interior surface of the cylindrical tube and surfaces of the reciprocating magnet, the material selected from the group consisting of: polyethylene terephthalate glycol (PETG), plastic, a non-magnetic metal, ceramics, and wood.

7. An anti-recoil device for being inserted in the stock of a firearm, comprising:

a cylindrical tube having a hollow core with first and second ends and a longitudinal axis;

a first end magnet disposed in a portion of the first end of the core and oriented in a first magnetic direction with the poles aligned with the longitudinal axis;

a second end magnet disposed in a portion of the second end of the core and oriented in the first magnetic direction;

a cylindrical reciprocating magnet with a diameter substantially equal to the diameter of the core disposed in a central portion of the core between the first and second ends of the core and movable between the first and second ends and first and second end magnets and oriented in a second magnetic direction opposing the first magnetic direction; and at least one vent hole through the surface of the tube proximate the first end portion and spaced apart therefrom by a predetermined distance of less than the length of the reciprocating magnet to allow air to escape from the core during reciprocation of the reciprocating magnet towards the at least one air vent hole and to compress air as the reciprocating magnet passes the at least one vent hole toward the first end portion.

8. The anti-recoil device of claim 7, wherein the length of the cylindrical tube is between 100 mm and 150 mm, and the maximum diameter of the cylindrical tube is no more than 130 mm.

9. The anti-recoil device of claim 8, wherein the reciprocating magnet and the end magnets are made of neodymium.

10. The anti-recoil device of claim 9, wherein the cylindrical tube is made of polyethylene terephthalate glycol.

11. The anti-recoil device of claim 10, further comprising a spacer assembly, the spacer assembly including:

a round nut having a hollow core with threads on an interior surface of the round nut core;

a cylindrical center screw threadably engaged with the hollow core of the round nut; and a locking nut having a hollow core with threads on an interior surface of the locking nut core, the locking nut threadably engaged with the center screw;

wherein the spacer assembly is disposed on an exterior of the cylindrical tube proximate the first end.

12. The anti-recoil device of claim 10, further comprising a first spring and a second spring disposed in the first and second end portions, respectively, to bias the first and second end magnets, respectively, toward the central portion.

13. An anti-recoil device for being inserted in the stock of a firearm, comprising:

a cylindrical tube having a hollow core with first and second ends and a longitudinal axis;

a first end magnet disposed in a portion of the first end of the core and oriented in a first magnetic direction with the poles aligned with the longitudinal axis;

a second end magnet disposed in a portion of the second end of the core and oriented in the first magnetic direction;

a reciprocating magnet disposed in a central portion of the core between the first and second ends of the core and movable between the first and second ends and first and second end magnets and oriented in a second magnetic direction opposing the first magnetic direction; and a coil with multiple windings wound about the outer surface of the tube to produce a reverse EMF when the reciprocating magnet reciprocates.

14. An anti-recoil device for being inserted in the stock of a firearm, comprising:

a cylindrical tube having a hollow core with first and second ends and a longitudinal axis;

a first end magnet disposed in a portion of the first end of the core and oriented in a first magnetic direction with the poles aligned with the longitudinal axis;

a second end magnet disposed in a portion of the second end of the core and oriented in the first magnetic direction;

a reciprocating magnet disposed in a central portion of the core between the first and second ends of the core and movable between the first and second ends and first and second end magnets and oriented in a second magnetic direction opposing the first magnetic direction; and further comprising a first spring and a second spring disposed in the first and second end portions, respectively, to bias the first and second end magnets, respectively, toward the central portion.

15. An anti-recoil device for being inserted in the stock of a firearm, comprising:

a cylindrical tube having a hollow core with first and second ends and a longitudinal axis;

a first end magnet disposed in a portion of the first end of the core and oriented in a first magnetic direction with the poles aligned with the longitudinal axis;

a second end magnet disposed in a portion of the second end of the core and oriented in the first magnetic direction;

a cylindrical reciprocating magnet disposed in a central portion of the core between the first and second ends of the core and movable between the first and second ends and first and second end magnets and oriented in a second magnetic direction opposing the first magnetic direction and having a diameter substantially equal to the diameter of the core; and a coil with multiple windings wound about the outer surface of the tube to produce a reverse EMF when the reciprocating magnet reciprocates;

wherein the tube has at least one vent hole through the surface of the tube proximate the first end portion and spaced apart therefrom by a predetermined distance of less than the length of the reciprocating magnet to allow air to escape from the core during reciprocation of the reciprocating magnet towards the at least one air vent hole and to compress air as the reciprocating magnet passes the at least one vent hole toward the first end portion.

16. An anti-recoil device for a firearm, comprising:

a tubular body having a body wall with an interior surface defining a tubular body interior and having a first end and a second end;

a first tubular end cap having an open first end and a closed second end, and having an end cap side wall with an interior surface, an end cap end wall with an interior surface, and an end cap interior defined by the interior surfaces of the end cap side wall and of the end cap end wall, wherein the end cap end wall of the first end cap is disposed at the closed second end of the first tubular end cap;

a second tubular end cap having an open first end and a closed second end, and having an end cap side wall with an interior surface, an end cap end wall with an interior surface, and an end cap interior defined by the interior surfaces of the end cap side wall and of the end cap end wall, wherein the end cap end wall of the second end cap is disposed at the closed second end of the second tubular end cap;

a central magnet having a first end with a first magnetic pole, second end with a second magnetic pole, and a center point between the first end and the second end;

a first end magnet having a first end with a first magnetic pole and a second end with a second magnetic pole;

a second end magnet having a first end with a first magnetic pole and a second end with a second magnetic pole;

wherein the central magnet is disposed within the body interior in a first orientation, the first orientation being that the first end of the central magnet is nearer to the first end of the tubular body than to the second end of the tubular body and that the second end of the central magnet is nearer to the second end of the tubular body than to the first end of the tubular body;

wherein the central magnet has a profile which allows sliding back and forth within the tubular body interior and which prevents the central magnet from rotating out of the first orientation;

wherein the first end magnet is disposed within the first end cap interior and is affixed to the first end cap, and is oriented such that the first end of the first end magnet is closer to the first end of the first end cap than is the second end of the first end magnet; and wherein the second end magnet is disposed within the second end cap interior and is affixed to the second end cap, and is oriented such that the first end of the second end magnet is closer to the first end of the second end cap than is the second end of the second end magnet;

wherein the first end cap is disposed at the first end of the tubular body and is oriented such that the tubular body interior opens into the end cap interior of the first end cap through the first end of the tubular body and the open first end of the first end cap;

wherein the second end cap is disposed at the second end of the tubular body and is oriented such that the tubular body interior opens into the end cap interior of the second end cap through the second end of the tubular body and the open first end of the second end cap;

wherein the first pole of the first end magnet and the first pole of the central magnet are like poles;

wherein the first pole of the second end magnet and the second pole of the central magnet are like poles; and an electromagnetic coil with multiple windings wound around the outer surface of the tubular body.

17. The anti-recoil device for a firearm of claim 16, wherein the profile of the central magnet is cylindrical.

18. The anti-recoil device for a firearm of claim 17, wherein the central magnet has a diameter substantially equal to the diameter of the tubular body interior.

19. The anti-recoil device for a firearm of claim 18, wherein the tubular body wall has a first vent hole connecting the tubular body interior to the exterior of the tubular body and is proximate to the first, and the tubular body wall has a second vent hole connecting the tubular body interior to the exterior of the tubular body and is proximate to the second end.

20. The anti-recoil device for a firearm of claim 19, wherein the first end magnet is affixed to the first end cap by a first spring, and the second end magnet is affixed to the second end cap by a second spring.

21. The anti-recoil device for a firearm of claim 19, wherein the first and second end caps are threadably engaged with the first and second ends of the tubular body, respectively.

22. The anti-recoil device for a firearm of claim 21, wherein the tubular body and the end caps are made of polyethylene terephthalate glycol.

* * * * *